US012454885B2

(12) United States Patent
Ramakrishnan et al.

(10) Patent No.: US 12,454,885 B2
(45) Date of Patent: Oct. 28, 2025

(54) BORE PLUG ANALYSIS SYSTEM

(71) Applicant: Schlumberger Technology Corporation, Sugar Land, TX (US)

(72) Inventors: Terizhandur S. Ramakrishnan, Boxborough, MA (US); Hua Zhang, Cambridge, MA (US)

(73) Assignee: Schlumberger Technology Corporation, Sugar Land, TX (US)

( * ) Notice: Subject to any disclaimer, the term of this patent is extended or adjusted under 35 U.S.C. 154(b) by 433 days.

(21) Appl. No.: 18/007,087

(22) PCT Filed: Jul. 29, 2021

(86) PCT No.: PCT/US2021/043725
§ 371 (c)(1),
(2) Date: Jan. 27, 2023

(87) PCT Pub. No.: WO2022/026727
PCT Pub. Date: Feb. 3, 2022

(65) Prior Publication Data

US 2023/0287785 A1 Sep. 14, 2023

Related U.S. Application Data

(60) Provisional application No. 63/059,383, filed on Jul. 31, 2020.

(51) Int. Cl.
*E21B 47/06* (2012.01)
*E21B 33/12* (2006.01)
*E21B 47/10* (2012.01)

(52) U.S. Cl.
CPC ..... *E21B 47/06* (2013.01); *E21B 33/12* (2013.01); *E21B 47/10* (2013.01)

(58) Field of Classification Search
CPC ..... E21B 47/06; E21B 33/12; E21B 47/10; E21B 33/134; E21B 47/00; E21B 47/103
See application file for complete search history.

(56) References Cited

U.S. PATENT DOCUMENTS 6,272,934 B1 * 8/2001 Rajan ..... G01F 1/74 73/861.63
2007/0234788 A1 * 10/2007 Glasbergen ..... E21B 47/07 73/152.55

(Continued)

FOREIGN PATENT DOCUMENTS

EP 3636876 A1 4/2020
WO 2015175169 A1 11/2015

(Continued)

OTHER PUBLICATIONS

Communication Pursuant to Article 94(3) issued in European Patent Application No. 21849516.6 dated Jan. 9, 2025, 6 pages.

(Continued)

*Primary Examiner* — Catherine T. Rastovski
*Assistant Examiner* — Yossef Korang-Beheshti
(74) *Attorney, Agent, or Firm* — Jeffrey D. Frantz

(57) ABSTRACT

A method can include receiving pressure data with respect to time acquired via a pressure sensor disposed in an uphole region of a bore of a well, where a plug is disposed in the bore to define the uphole region to one side of the plug and a corresponding downhole region to the other side of the plug; using at least physical properties of liquid in the uphole region and thermal information, computing a temperature and gravitational head induced density variation of the liquid in the uphole region; and, based at least in part on at least a portion of the pressure data and the temperature and gravi- (Continued)

tational head induced density variation of the liquid, determining a state of the plug and the bore from a plurality of states.

19 Claims, 13 Drawing Sheets

(56) References Cited

U.S. PATENT DOCUMENTS

| | | | | |
|---|---|---|---|---|
| 2010/0270032 | A1* | 10/2010 | Monjure | E21B 33/03 166/381 |
| 2013/0111885 | A1 | 5/2013 | Liljestrand | |
| 2013/0111985 | A1* | 5/2013 | Veeningen | E21B 47/117 73/152.51 |
| 2014/0123747 | A1 | 5/2014 | Veeningen | |
| 2017/0275987 | A1 | 9/2017 | Al-Hussain | |
| 2017/0350234 | A1 | 12/2017 | Xia | |
| 2018/0051535 | A1* | 2/2018 | Wang | E21B 34/10 |
| 2020/0318464 | A1* | 10/2020 | Atchison | E21B 3/02 |
| 2020/0378242 | A1* | 12/2020 | Jabari | E21B 47/12 |
| 2021/0148190 | A1 | 5/2021 | Ramakrishnan | |
| 2021/0155841 | A1 | 5/2021 | Ramakrishnan et al. | |
| 2021/0164322 | A1 | 6/2021 | Ramakrishnan | |

FOREIGN PATENT DOCUMENTS

| | | | |
|---|---|---|---|
| WO | 2017135827 | A1 | 8/2017 |
| WO | 2019194844 | A1 | 10/2019 |
| WO | 2022026683 | A1 | 2/2022 |

OTHER PUBLICATIONS

Extended Search Report issued in European Patent Application No. 21851255.6 dated Nov. 24, 2023, 6 pages.

Extended Search Report issued in European Patent Application No. 21849516.6 dated Nov. 21, 2023, 7 pages.

International Preliminary Report on Patentability issued in the PCT Application PCT/US2021/043666 dated Feb. 9, 2023, 6 pages.

International Preliminary Report on Patentability issued in the PCT Application PCT/US2021/043725 dated Feb. 9, 2023, 8 pages.

International Search Report and Written Opinion issued in the PCT Application PCT/US2021/043666, dated Nov. 8, 2021 (9 pages).

International Search Report and Written Opinion issued in the PCT Application PCT/US2021/043725, dated Nov. 16, 2021 (11 pages).

* cited by examiner

510

530

BORE PLUG ANALYSIS SYSTEM

CROSS-REFERENCE TO RELATED APPLICATIONS

This application is a National Stage Entry of International Patent Application No. PCT/US2021/043725, filed on Jul. 29, 2021, which claims priority to U.S. Provisional Application No. 63/059,383, filed on Jul. 31, 2020, the entirety of each of which is incorporated herein by reference.

BACKGROUND

A resource field can be an accumulation, pool or group of pools of one or more resources (e.g., oil, gas, oil and gas) in a subsurface environment. A resource field can include at least one reservoir. A reservoir may be shaped in a manner that can trap hydrocarbons and may be covered by an impermeable or sealing rock. A bore can be drilled into an environment where the bore or borehole may be utilized to form a well that can be utilized for injection and/or production. For example, consider a well that can be utilized for producing hydrocarbons from a reservoir.

A rig can be a system of components that can be operated to form a borehole in an environment, to transport equipment and/or materials into and out of a borehole in an environment, etc. As an example, a rig can include a system that can be used to drill a borehole and to acquire information about an environment, about drilling, etc. As a resource field may be an onshore field, an offshore field or an on- and offshore field, a rig may include components appropriate for performing operations onshore and/or offshore. A rig may be, for example, vessel-based, offshore platform-based, onshore, etc.

After borehole is drilled, sections of pipe (e.g., casings, etc.) can be placed into the borehole. Casings may be fixed in a borehole using cement. For example, consider a process that includes pumping cement into an annulus between a casing and a formation (e.g., a wall of a borehole). In such an example, cement can provide structural integrity for a casing and can isolate one or more zones in an earth formation such that they are not in fluid communication with each other via the borehole. Insertion and placement of casings can be part of a completions process that includes performing various events and using various equipment to "complete" a well such that the completed well can be utilized for injection, production, etc. As an example, a completions process can include making perforations in casing through which fluid communication can be established between a wellbore and a formation.

Field planning and/or development can occur over one or more phases, which can include an exploration phase that aims to identify and assess an environment (e.g., a prospect, a play, etc.), which may include drilling of one or more bores (e.g., one or more exploratory wells, etc.). As explained, development can include drilling a borehole and performing a completions process to complete a well where the well can include a wellbore that is to be utilized to produce fluid from a reservoir. As appropriate, various types of equipment may be utilized to improve production of fluid from a reservoir. For example, one or more of artificial lift technology, hydraulic fracturing technology, injection technology, etc., may be utilized.

As explained, a well may be planned and developed for purposes of one or more of injection and production. Depending on one or more factors, a decision may be made to perform a plugging operation to plug a well, a branch of a well, etc. For a production well, such a decision may depend on sustainable production levels, which may consider characteristics of reservoir fluid, resource utilization, etc. A decision may depend on one or more other factors such as, for example, safety, which can consider one or more of equipment safety, human safety, and environmental safety. A plugging operation may be part of a decision to plug and abandon (P&A) a well or a portion of a well (e.g., a branch, etc.). For example, a P&A process can including performing a plugging operation to form a plug in a wellbore to shut-in and permanently isolate the wellbore. In such an example, the plug can be a seal element that aims to form a seal that hinders flow of fluid from one side of the plug to another side of the plug. For one or more reasons, a plug may leak. As such, a P&A process can include performing leak detection. Where a leak is detected and determined to be unacceptable, one or more actions may be performed to address the leak.

SUMMARY

A method can include receiving pressure data with respect to time acquired via a pressure sensor disposed in an uphole region of a bore of a well, where a plug is disposed in the bore to define the uphole region to one side of the plug and a corresponding downhole region to the other side of the plug; using at least physical properties of liquid in the uphole region and thermal information, computing a temperature and gravitational head induced density variation of the liquid in the uphole region; and, based at least in part on at least a portion of the pressure data and the temperature and gravitational head induced density variation of the liquid, determining a state of the plug and the bore from a plurality of states. A system can include a processor; memory accessible by the processor; processor-executable instructions stored in the memory and executable to instruct the system to: receive pressure data with respect to time acquired via a pressure sensor disposed in an uphole region of a bore of a well, where a plug is disposed in the bore to define the uphole region to one side of the plug and a corresponding downhole region to the other side of the plug; using at least physical properties of liquid in the uphole region and thermal information, compute a temperature and gravitational head induced density variation of the liquid in the uphole region; and, based at least in part on at least a portion of the pressure data and the temperature and gravitational head induced density variation of the liquid, determine a state of the plug and the bore from a plurality of states. One or more computer-readable storage media can include processor-executable instructions to instruct a computing system to: receive pressure data with respect to time acquired via a pressure sensor disposed in an uphole region of a bore of a well, wherein a plug is disposed in the bore to define the uphole region to one side of the plug and a corresponding downhole region to the other side of the plug; using at least physical properties of liquid in the uphole region and thermal information, compute a temperature and gravitational head induced density variation of the liquid in the uphole region; and, based at least in part on at least a portion of the pressure data and the temperature and gravitational head induced density variation of the liquid, determine a state of the plug and the bore from a plurality of states. Various other apparatuses, systems, methods, etc., are also disclosed.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

Features and advantages of the described implementations can be more readily understood by reference to the following description taken in conjunction with the accompanying drawings.

DETAILED DESCRIPTION

The following description includes the best mode presently contemplated for practicing the described implementations. This description is not to be taken in a limiting sense, but rather is made merely for the purpose of describing the general principles of the implementations. The scope of the described implementations should be ascertained with reference to the issued claims.

Figure 1:
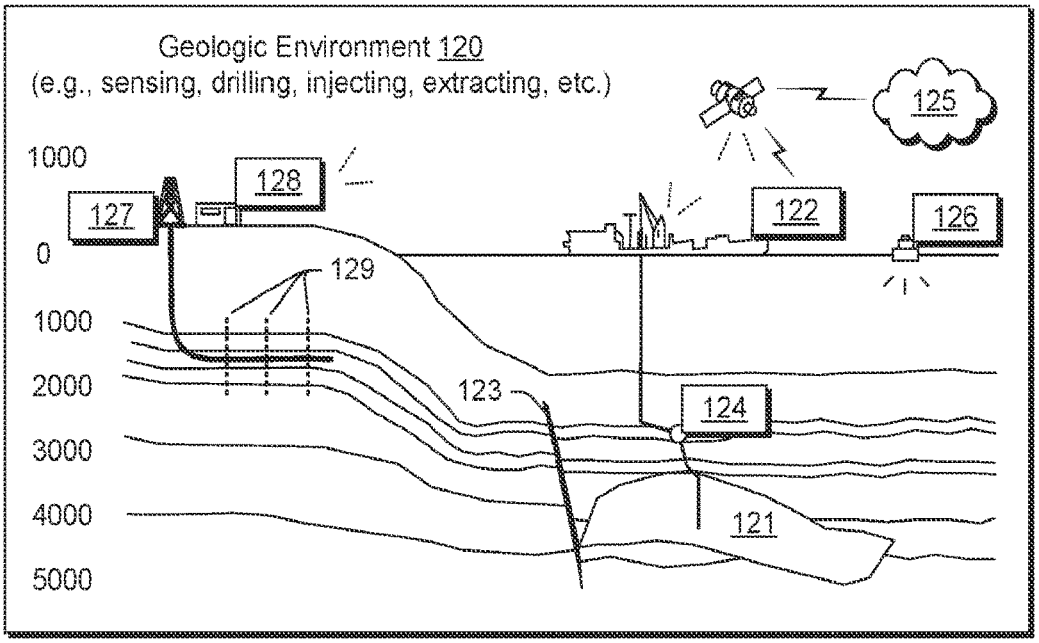
FIG. 1 illustrates examples of equipment in a geologic environment.
Figure 1:
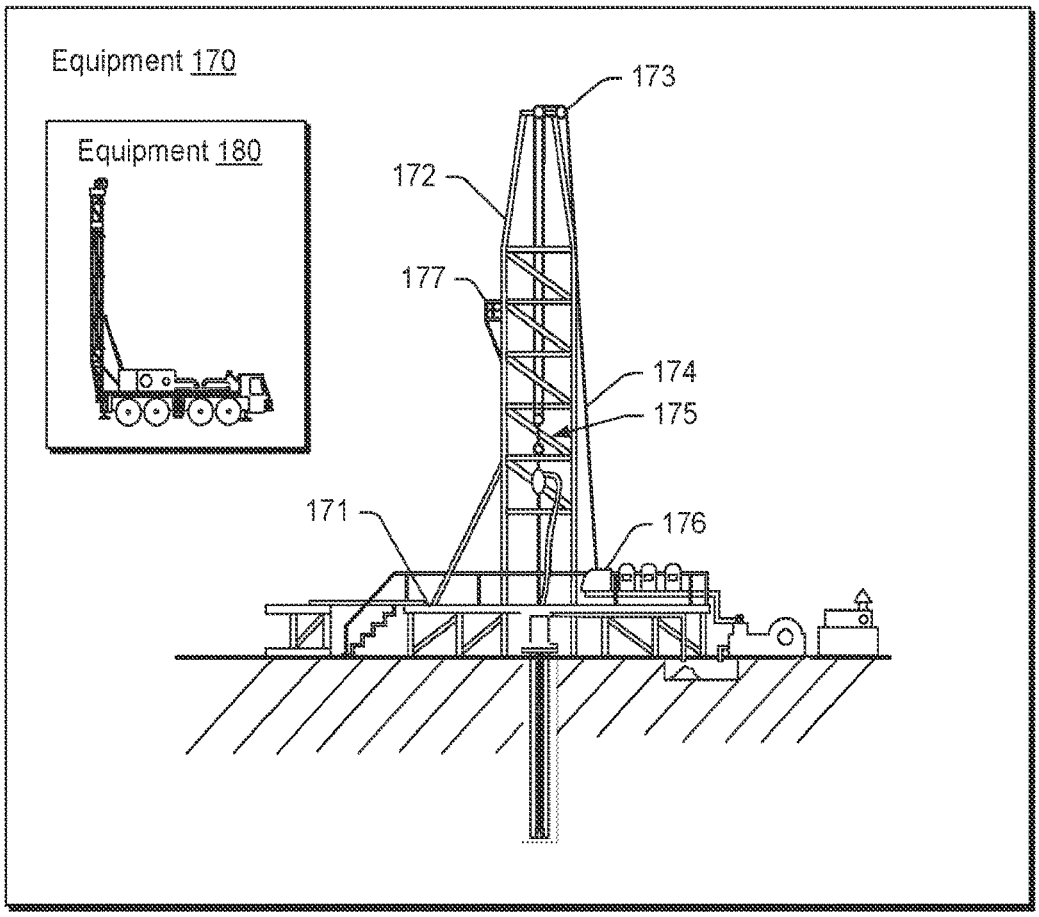

FIG. 1 shows an example of a geologic environment 120. In FIG. 1, the geologic environment 120 may be a sedimentary basin that includes layers (e.g., stratification) that include a reservoir 121 and that may be, for example, intersected by a fault 123 (e.g., or faults). As an example, the geologic environment 120 may be outfitted with any of a variety of sensors, detectors, actuators, etc. For example, equipment 122 may include communication circuitry to receive and to transmit information with respect to one or more networks 125. Such information may include information associated with downhole equipment 124, which may be equipment to acquire information, to assist with resource recovery, etc. Other equipment 126 may be located remote from a well site and include sensing, detecting, emitting or other circuitry. Such equipment may include storage and communication circuitry to store and to communicate data, instructions, etc. As an example, one or more pieces of equipment may provide for measurement, collection, communication, storage, analysis, etc. of data (e.g., for one or more produced resources, etc.). As an example, one or more satellites may be provided for purposes of communications, data acquisition, etc. For example, FIG. 1 shows a satellite in communication with the network 125 that may be configured for communications, noting that the satellite may additionally or alternatively include circuitry for imagery (e.g., spatial, spectral, temporal, radiometric, etc.).

FIG. 1 also shows the geologic environment 120 as optionally including equipment 127 and 128 associated with a well that includes a substantially horizontal portion that may intersect with one or more fractures 129. For example, consider a well in a shale formation that may include natural fractures, artificial fractures (e.g., hydraulic fractures) or a combination of natural and artificial fractures. As an example, a well may be drilled for a reservoir that is laterally extensive. In such an example, lateral variations in properties, stresses, etc. may exist where an assessment of such variations may assist with planning, operations, etc. to develop the reservoir (e.g., via fracturing, injecting, extracting, etc.). As an example, the equipment 127 and/or 128 may include components, a system, systems, etc. for fracturing, seismic sensing, analysis of seismic data, assessment of one or more fractures, injection, production, etc. As an example, the equipment 127 and/or 128 may provide for measurement, collection, communication, storage, analysis, etc. of data such as, for example, production data (e.g., for one or more produced resources). As an example, one or more satellites may be provided for purposes of communications, data acquisition, etc.

FIG. 1 also shows an example of equipment 170 and an example of equipment 180. Such equipment, which may be systems of components, may be suitable for use in the geologic environment 120. While the equipment 170 and 180 are illustrated as land-based, various components may be suitable for use in an offshore system.

The equipment 170 includes a platform 171, a derrick 172, a crown block 173, a line 174, a traveling block assembly 175, drawworks 176 and a landing 177 (e.g., a monkeyboard). As an example, the line 174 may be controlled at least in part via the drawworks 176 such that the traveling block assembly 175 travels in a vertical direction with respect to the platform 171. For example, by drawing the line 174 in, the drawworks 176 may cause the line 174 to run through the crown block 173 and lift the traveling block assembly 175 skyward away from the platform 171; whereas, by allowing the line 174 out, the drawworks 176 may cause the line 174 to run through the crown block 173 and lower the traveling block assembly 175 toward the platform 171. Where the traveling block assembly 175 carries pipe (e.g., casing, etc.), tracking of movement of the traveling block 175 may provide an indication as to how much pipe has been deployed.

A derrick can be a structure used to support a crown block and a traveling block operatively coupled to the crown block at least in part via line. A derrick may be pyramidal in shape and offer a suitable strength-to-weight ratio. A derrick may be movable as a unit or in a piece by piece manner (e.g., to be assembled and disassembled).

As an example, drawworks may include a spool, brakes, a power source and assorted auxiliary devices. Drawworks may controllably reel out and reel in line. Line may be reeled over a crown block and coupled to a traveling block to gain mechanical advantage in a "block and tackle" or "pulley" fashion. Reeling out and in of line can cause a traveling block (e.g., and whatever may be hanging underneath it), to be lowered into or raised out of a bore. Reeling out of line may be powered by gravity and reeling in by a motor, an engine, etc. (e.g., an electric motor, a diesel engine, etc.).

As an example, a crown block can include a set of pulleys (e.g., sheaves) that can be located at or near a top of a derrick or a mast, over which line is threaded. A traveling block can include a set of sheaves that can be moved up and down in a derrick or a mast via line threaded in the set of sheaves of the traveling block and in the set of sheaves of a crown block. A crown block, a traveling block and a line can form a pulley system of a derrick or a mast, which may enable handling of heavy loads (e.g., drillstring, pipe, casing, liners, etc.) to be lifted out of or lowered into a bore. As an example, line may be about a centimeter to about five centimeters in diameter as, for example, steel cable. Through use of a set of sheaves, such line may carry loads heavier than the line could support as a single strand.

As an example, a derrickman may be a rig crew member that works on a platform attached to a derrick or a mast. A derrick can include a landing on which a derrickman may stand. As an example, such a landing may be about 10 meters or more above a rig floor. In an operation referred to as trip out of the hole (TOH), a derrickman may wear a safety harness that enables leaning out from the work landing (e.g., monkeyboard) to reach pipe in located at or near the center of a derrick or a mast and to throw a line around the pipe and pull it back into its storage location (e.g., fingerboards), for example, until it a time at which it may be desirable to run the pipe back into the bore. As an example, a rig may include automated pipe-handling equipment such that the derrickman controls the machinery rather than physically handling the pipe.

As an example, a trip may refer to the act of pulling equipment from a bore and/or placing equipment in a bore. As an example, equipment may include a drillstring that can be pulled out of a hole and/or placed or replaced in a hole. As an example, a pipe trip may be performed where a drill bit has dulled or has otherwise ceased to drill efficiently and is to be replaced.

Figure 2:
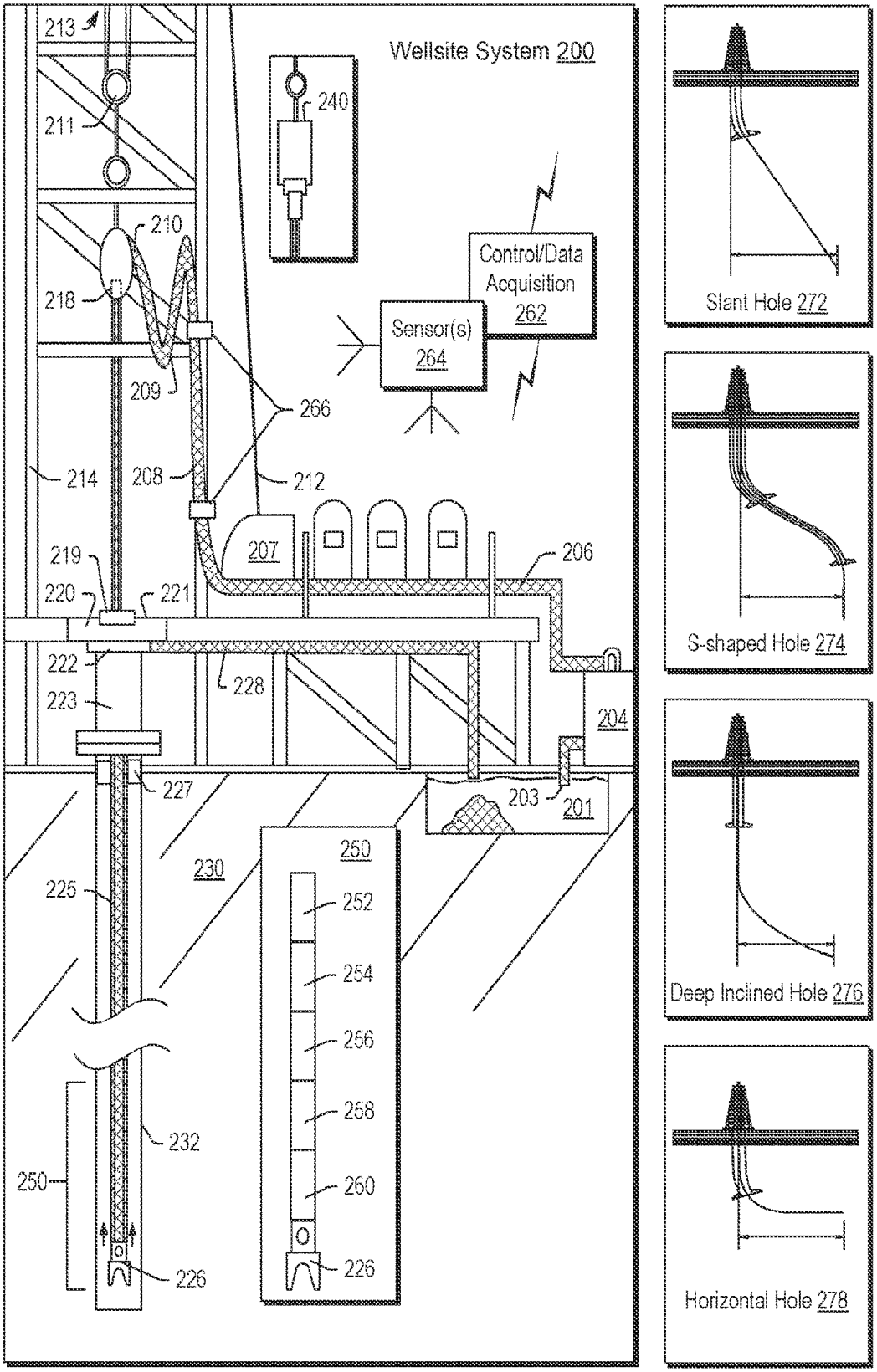
FIG. 2 illustrates examples of equipment and examples of hole types.

FIG. 2 shows an example of a wellsite system 200 (e.g., at a wellsite that may be onshore or offshore). As shown, the wellsite system 200 can include a mud tank 201 for holding mud and other material (e.g., where mud can be a drilling fluid), a suction line 203 that serves as an inlet to a mud pump 204 for pumping mud from the mud tank 201 such that mud flows to a vibrating hose 206, a drawworks 207 for winching drill line or drill lines 212, a standpipe 208 that receives mud from the vibrating hose 206, a kelly hose 209 that receives mud from the standpipe 208, a gooseneck or goosenecks 210, a traveling block 211, a crown block 213 for carrying the traveling block 211 via the drill line or drill lines 212 (see, e.g., the crown block 173 of FIG. 1), a derrick 214 (see, e.g., the derrick 172 of FIG. 1), a kelly 218 or a top drive 240, a kelly drive bushing 219, a rotary table 220, a drill floor 221, a bell nipple 222, one or more blowout preventors (BOPs) 223, a drillstring 225, a drill bit 226, a casing head 227 and a flow pipe 228 that carries mud and other material to, for example, the mud tank 201.

In the example system of FIG. 2, a borehole 232 is formed in subsurface formations 230 by rotary drilling; noting that various example embodiments may also use directional drilling.

As shown in the example of FIG. 2, the drillstring 225 is suspended within the borehole 232 and has a drillstring assembly 250 that includes the drill bit 226 at its lower end. As an example, the drillstring assembly 250 may be a bottom hole assembly (BHA).

The wellsite system 200 can provide for operation of the drillstring 225 and other operations. As shown, the wellsite system 200 includes the platform 211 and the derrick 214 positioned over the borehole 232. As mentioned, the wellsite system 200 can include the rotary table 220 where the drillstring 225 pass through an opening in the rotary table 220.

As shown in the example of FIG. 2, the wellsite system 200 can include the kelly 218 and associated components, etc., or a top drive 240 and associated components. As to a kelly example, the kelly 218 may be a square or hexagonal metal/alloy bar with a hole drilled therein that serves as a mud flow path. The kelly 218 can be used to transmit rotary motion from the rotary table 220 via the kelly drive bushing 219 to the drillstring 225, while allowing the drillstring 225 to be lowered or raised during rotation. The kelly 218 can pass through the kelly drive bushing 219, which can be driven by the rotary table 220. As an example, the rotary table 220 can include a master bushing that operatively couples to the kelly drive bushing 219 such that rotation of the rotary table 220 can turn the kelly drive bushing 219 and hence the kelly 218. The kelly drive bushing 219 can include an inside profile matching an outside profile (e.g., square, hexagonal, etc.) of the kelly 218; however, with slightly larger dimensions so that the kelly 218 can freely move up and down inside the kelly drive bushing 219.

As to a top drive example, the top drive 240 can provide functions performed by a kelly and a rotary table. The top drive 240 can turn the drillstring 225. As an example, the top drive 240 can include one or more motors (e.g., electric and/or hydraulic) connected with appropriate gearing to a short section of pipe called a quill, that in turn may be screwed into a saver sub or the drillstring 225 itself. The top drive 240 can be suspended from the traveling block 211, so the rotary mechanism is free to travel up and down the derrick 214. As an example, a top drive 240 may allow for drilling to be performed with more joint stands than a kelly/rotary table approach.

In the example of FIG. 2, the mud tank 201 can hold mud, which can be one or more types of drilling fluids. As an example, a wellbore may be drilled to produce fluid, inject fluid or both (e.g., hydrocarbons, minerals, water, etc.).

In the example of FIG. 2, the drillstring 225 (e.g., including one or more downhole tools) may be composed of a series of pipes threadably connected together to form a long tube with the drill bit 226 at the lower end thereof. As the drillstring 225 is advanced into a wellbore for drilling, at some point in time prior to or coincident with drilling, the mud may be pumped by the pump 204 from the mud tank 201 (e.g., or other source) via a the lines 206, 208 and 209 to a port of the kelly 218 or, for example, to a port of the top drive 240. The mud can then flow via a passage (e.g., or passages) in the drillstring 225 and out of ports located on the drill bit 226 (see, e.g., a directional arrow). As the mud exits the drillstring 225 via ports in the drill bit 226, it can then circulate upwardly through an annular region between an outer surface(s) of the drillstring 225 and surrounding wall(s) (e.g., open borehole, casing, etc.), as indicated by directional arrows. In such a manner, the mud lubricates the drill bit 226 and carries heat energy (e.g., frictional or other energy) and formation cuttings to the surface where the mud (e.g., and cuttings) may be returned to the mud tank 201, for example, for recirculation (e.g., with processing to remove cuttings, etc.).

The mud pumped by the pump 204 into the drillstring 225 may, after exiting the drillstring 225, form a mudcake that lines the wellbore which, among other functions, may reduce friction between the drillstring 225 and surrounding wall(s) (e.g., borehole, casing, etc.). A reduction in friction may facilitate advancing or retracting the drillstring 225. During a drilling operation, the entire drill string 225 may be pulled from a wellbore and optionally replaced, for example, with a new or sharpened drill bit, a smaller diameter drill string, etc. As mentioned, the act of pulling a drill string out of a hole or replacing it in a hole is referred to as tripping.

A trip may be referred to as an upward trip or an outward trip or as a downward trip or an inward trip depending on trip direction.

As an example, consider a downward trip where upon arrival of the drill bit 226 of the drill string 225 at a bottom of a wellbore, pumping of the mud commences to lubricate the drill bit 226 for purposes of drilling to enlarge the wellbore. As mentioned, the mud can be pumped by the pump 204 into a passage of the drillstring 225 and, upon filling of the passage, the mud may be used as a transmission medium to transmit energy, for example, energy that may encode information as in mud-pulse telemetry.

As an example, mud-pulse telemetry equipment may include a downhole device configured to effect changes in pressure in the mud to create an acoustic wave or waves upon which information may modulated. In such an example, information from downhole equipment (e.g., one or more modules of the drillstring 225) may be transmitted uphole to an uphole device, which may relay such information to other equipment for processing, control, etc.

As an example, telemetry equipment may operate via transmission of energy via the drillstring 225 itself. For example, consider a signal generator that imparts coded energy signals to the drillstring 225 and repeaters that may receive such energy and repeat it to further transmit the coded energy signals (e.g., information, etc.).

As an example, the drillstring 225 may be fitted with telemetry equipment 252 that includes a rotatable drive shaft, a turbine impeller mechanically coupled to the drive shaft such that the mud can cause the turbine impeller to rotate, a modulator rotor mechanically coupled to the drive shaft such that rotation of the turbine impeller causes said modulator rotor to rotate, a modulator stator mounted adjacent to or proximate to the modulator rotor such that rotation of the modulator rotor relative to the modulator stator creates pressure pulses in the mud, and a controllable brake for selectively braking rotation of the modulator rotor to modulate pressure pulses. In such example, an alternator may be coupled to the aforementioned drive shaft where the alternator includes at least one stator winding electrically coupled to a control circuit to selectively short the at least one stator winding to electromagnetically brake the alternator and thereby selectively brake rotation of the modulator rotor to modulate the pressure pulses in the mud.

In the example of FIG. 2, an uphole control and/or data acquisition system 262 may include circuitry to sense pressure pulses generated by telemetry equipment 252 and, for example, communicate sensed pressure pulses or information derived therefrom for process, control, etc.

The assembly 250 of the illustrated example includes a logging-while-drilling (LWD) module 254, a measuring-while-drilling (MWD) module 256, an optional module 258, a roto-steerable system and motor 260, and the drill bit 226. Such components or modules may be referred to as tools where a drillstring can include a plurality of tools.

The LWD module 254 may be housed in a suitable type of drill collar and can contain one or a plurality of selected types of logging tools. It will also be understood that more than one LWD and/or MWD module can be employed, for example, as represented at by the module 256 of the drillstring assembly 250. Where the position of an LWD module is mentioned, as an example, it may refer to a module at the position of the LWD module 254, the module 256, etc. An LWD module can include capabilities for measuring, processing, and storing information, as well as for communicating with the surface equipment. In the illustrated example, the LWD module 254 may include a seismic measuring device.

The MWD module 256 may be housed in a suitable type of drill collar and can contain one or more devices for measuring characteristics of the drillstring 225 and the drill bit 226. As an example, the MWD tool 254 may include equipment for generating electrical power, for example, to power various components of the drillstring 225. As an example, the MWD tool 254 may include the telemetry equipment 252, for example, where the turbine impeller can generate power by flow of the mud; it being understood that other power and/or battery systems may be employed for purposes of powering various components. As an example, the MWD module 256 may include one or more of the following types of measuring devices: a weight-on-bit measuring device, a torque measuring device, a vibration measuring device, a shock measuring device, a stick slip measuring device, a direction measuring device, and an inclination measuring device.

FIG. 2 also shows some examples of types of holes that may be drilled. For example, consider a slant hole 272, an S-shaped hole 274, a deep inclined hole 276 and a horizontal hole 278.

As an example, a drilling operation can include directional drilling where, for example, at least a portion of a well includes a curved axis. For example, consider a radius that defines curvature where an inclination with regard to the vertical may vary until reaching an angle between about 30 degrees and about 60 degrees or, for example, an angle to about 90 degrees or possibly greater than about 90 degrees.

As an example, a directional well can include several shapes where each of the shapes may aim to meet particular operational demands. As an example, a drilling process may be performed on the basis of information as and when it is relayed to a drilling engineer. As an example, inclination and/or direction may be modified based on information received during a drilling process.

As an example, deviation of a bore may be accomplished in part by use of a downhole motor and/or a turbine. As to a motor, for example, a drillstring can include a positive displacement motor (PDM).

As an example, a system may be a steerable system and include equipment to perform a method such as geosteering. As an example, a steerable system can include a PDM or a turbine on a lower part of a drillstring which, just above a drill bit, a bent sub can be mounted. As an example, above a PDM, MWD equipment that provides real time or near real time data of interest (e.g., inclination, direction, pressure, temperature, real weight on the drill bit, torque stress, etc.) and/or LWD equipment may be installed. As to the latter, LWD equipment can make it possible to send to the surface various types of data of interest, including for example, geological data (e.g., gamma ray log, resistivity, density and sonic logs, etc.).

The coupling of sensors providing information on the course of a well trajectory, in real time or near real time, with, for example, one or more logs characterizing the formations from a geological viewpoint, can allow for implementing a geosteering method. Such a method can include navigating a subsurface environment, for example, to follow a desired route to reach a desired target or targets.

As an example, a drillstring can include an azimuthal density neutron (ADN) tool for measuring density and porosity; a MWD tool for measuring inclination, azimuth and shocks; a compensated dual resistivity (CDR) tool for measuring resistivity and gamma ray related phenomena;

one or more variable gauge stabilizers; one or more bend joints; and a geosteering tool, which may include a motor and optionally equipment for measuring and/or responding to one or more of inclination, resistivity and gamma ray related phenomena.

As an example, geosteering can include intentional directional control of a wellbore based on results of downhole geological logging measurements in a manner that aims to keep a directional wellbore within a desired region, zone (e.g., a pay zone), etc. As an example, geosteering may include directing a wellbore to keep the wellbore in a particular section of a reservoir, for example, to minimize gas and/or water breakthrough and, for example, to maximize economic production from a well that includes the wellbore.

Referring again to FIG. 2, the wellsite system 200 can include one or more sensors 264 that are operatively coupled to the control and/or data acquisition system 262. As an example, a sensor or sensors may be at surface locations. As an example, a sensor or sensors may be at downhole locations. As an example, a sensor or sensors may be at one or more remote locations that are not within a distance of the order of about one hundred meters from the wellsite system 200. As an example, a sensor or sensor may be at an offset wellsite where the wellsite system 200 and the offset wellsite are in a common field (e.g., oil and/or gas field).

As an example, one or more of the sensors 264 can be provided for tracking pipe, tracking movement of at least a portion of a drillstring, etc.

As an example, the system 200 can include one or more sensors 266 that can sense and/or transmit signals to a fluid conduit such as a drilling fluid conduit (e.g., a drilling mud conduit). For example, in the system 200, the one or more sensors 266 can be operatively coupled to portions of the standpipe 208 through which mud flows. As an example, a downhole tool can generate pulses that can travel through the mud and be sensed by one or more of the one or more sensors 266. In such an example, the downhole tool can include associated circuitry such as, for example, encoding circuitry that can encode signals, for example, to reduce demands as to transmission. As an example, circuitry at the surface may include decoding circuitry to decode encoded information transmitted at least in part via mud-pulse telemetry. As an example, circuitry at the surface may include encoder circuitry and/or decoder circuitry and circuitry downhole may include encoder circuitry and/or decoder circuitry. As an example, the system 200 can include a transmitter that can generate signals that can be transmitted downhole via mud (e.g., drilling fluid) as a transmission medium.

As an example, one or more portions of a drillstring may become stuck. The term stuck can refer to one or more of varying degrees of inability to move or remove a drillstring from a bore. As an example, in a stuck condition, it might be possible to rotate pipe or lower it back into a bore or, for example, in a stuck condition, there may be an inability to move the drillstring axially in the bore, though some amount of rotation may be possible. As an example, in a stuck condition, there may be an inability to move at least a portion of the drillstring axially and rotationally.

As to the term "stuck pipe", this can refer to a portion of a drillstring that cannot be rotated or moved axially. As an example, a condition referred to as "differential sticking" can be a condition whereby the drillstring cannot be moved (e.g., rotated or reciprocated) along the axis of the bore. Differential sticking may occur when high-contact forces caused by low reservoir pressures, high wellbore pressures, or both, are exerted over a sufficiently large area of the drillstring. Differential sticking can have time and financial cost.

As an example, a sticking force can be a product of the differential pressure between the wellbore and the reservoir and the area that the differential pressure is acting upon. This means that a relatively low differential pressure (delta p) applied over a large working area can be just as effective in sticking pipe as can a high differential pressure applied over a small area.

As an example, a condition referred to as "mechanical sticking" can be a condition where limiting or prevention of motion of the drillstring by a mechanism other than differential pressure sticking occurs. Mechanical sticking can be caused, for example, by one or more of junk in the hole, wellbore geometry anomalies, cement, keyseats or a buildup of cuttings in the annulus.

Figure 3:
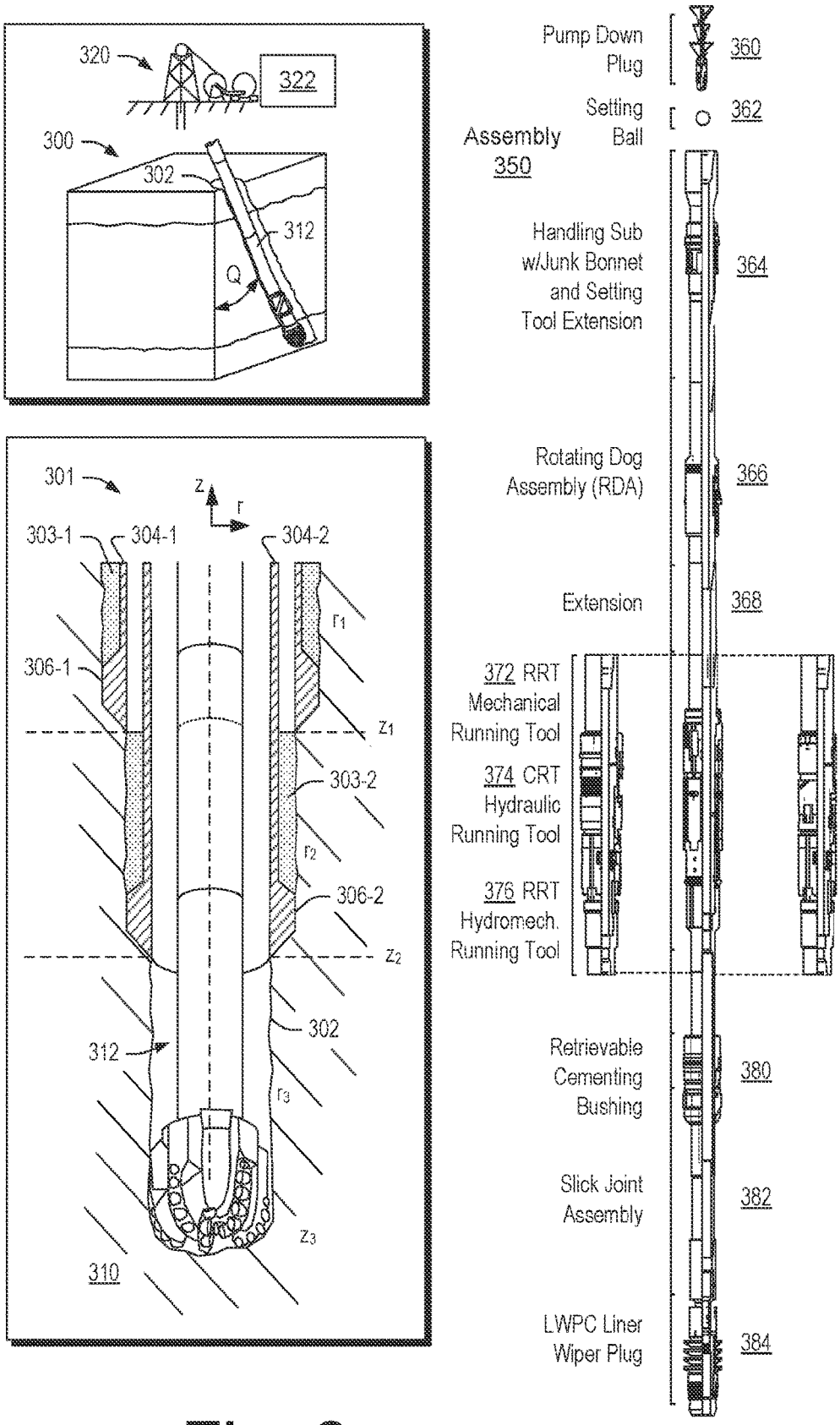
FIG. 3 illustrates examples of equipment in various example environments.
Figure 4:
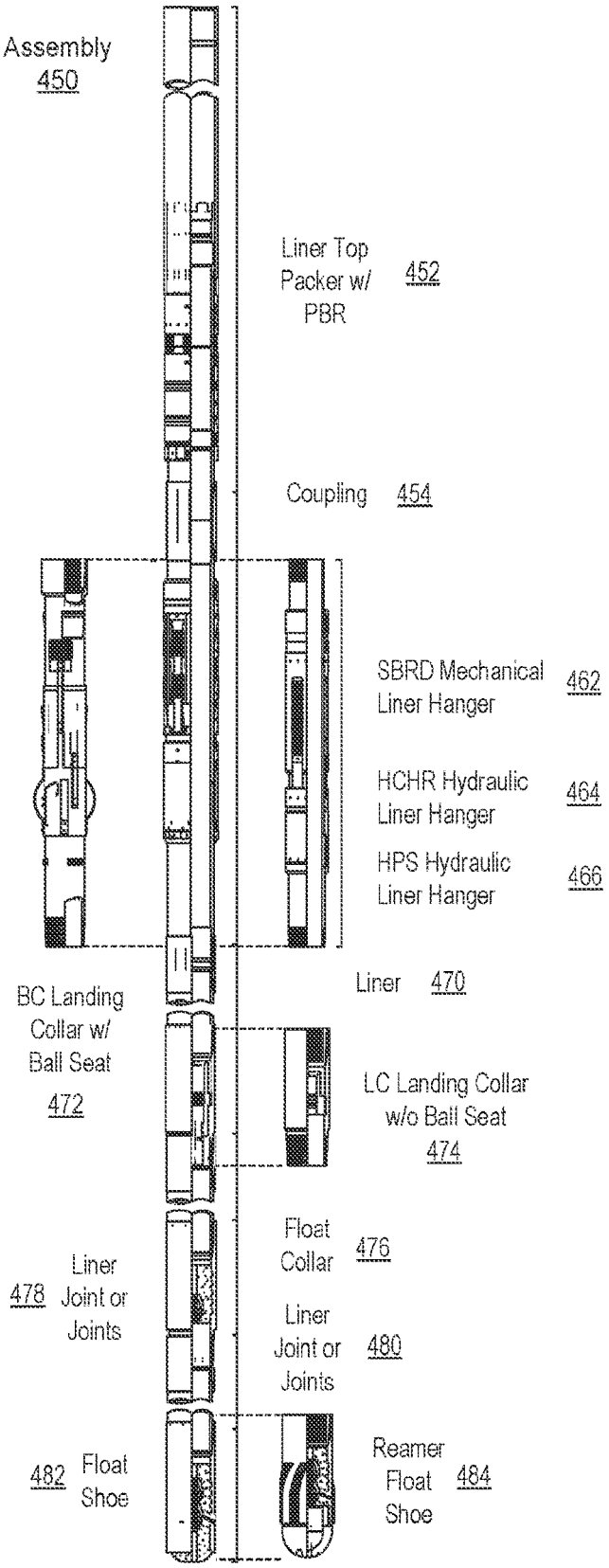
FIG. 4 illustrates examples of equipment.

FIGS. 3 and 4 show an example of an environment 300, an example of a portion of a completion 301, an example of equipment 320 and examples of assemblies 350 and 450, which may be utilized in one or more completions operations. As an example, the equipment 320 may include a rig, a turntable, a pump, drilling equipment, pumping equipment, equipment for deploying an assembly, a part of an assembly, etc. As an example, the equipment 320 may include one or more controllers 322. As an example, a controller may include one or more processors, memory and instructions stored in memory that are executable by a processor, for example, to control one or more pieces of equipment (e.g., motors, pumps, sensors, etc.). As an example, the equipment 320 may be deployed at least in part at a well site and, optionally, in part at a remote site.

In FIG. 3, the environment 300 includes a subterranean formation into which a bore 302 extends where a tool 312 such as, for example, a drill string is disposed in the bore 302. As an example, the bore 302 may be defined in part by an angle (Θ); noting that while the bore 302 is shown as being deviated, it may be vertical (e.g., or include one or more vertical sections along with one or more deviated sections). As shown in an enlarged view with respect to an r, z coordinate system (e.g., a cylindrical coordinate system), a portion of the bore 302 includes casings 304-1 and 304-2 having casing shoes 306-1 and 306-2. As shown, cement annuli 303-1 and 303-2 are disposed between the bore 302 and the casings 304-1 and 304-2. Cement such as the cement annuli 303-1 and 303-2 can support and protect casings such as the casings 304-1 and 304-2 and when cement is disposed throughout various portions of a wellbore such as the wellbore 302, cement may help achieve zonal isolation.

In the example of FIG. 3, the bore 302 has been drilled in sections or segments beginning with a large diameter section (see, e.g., $r_1$) followed by an intermediate diameter section (see, e.g., $r_2$) and a smaller diameter section (see, e.g., $r_3$). As an example, a large diameter section may be a surface casing section, which may be three or more feet in diameter and extend down several hundred feet to several thousand feet. A surface casing section may aim to prevent washout of loose unconsolidated formations. As to an intermediate casing section, it may aim to isolate and protect high pressure zones, guard against lost circulation zones, etc. As an example, intermediate casing may be set at about 6000 feet (e.g., about 2000 m) and extend lower with one or more intermediate casing portions of decreasing diameter (e.g., in a range from about thirteen to about five inches in diameter). A so-called production casing section may extend below an intermediate casing section and, upon completion, be the longest running section within a wellbore (e.g., a production casing section may be thousands of feet in length). As an example, production casing may be located in a target zone where the casing is perforated for flow of fluid into a bore of the casing.

A liner may be a casing (e.g., a completion component) that may be installed via a liner hanger system. As an example, a liner hanger system may include various features such as, for example, one or more of the features of the assembly 350 and/or the assembly 450 of FIGS. 3 and 4.

As shown in FIG. 3, the assembly 350 can include a pump down plug 360, a setting ball 362, a handling sub with a junk bonnet and setting tool extension 364, a rotating dog assembly (RDA) 366, an extension(s) 368, a mechanical running tool 372, a hydraulic running tool 374, a hydromechanical running tool 376, a retrievable cementing bushing 380, a slick joint assembly 382 and/or a liner wiper plug 384.

As shown in FIG. 4, the assembly 450 can include a liner top packer with a polished bore receptacle (PBR) 452, a coupling(s) 454, a mechanical liner hanger 462, a hydraulic liner hanger 464, a hydraulic liner hanger 466, a liner(s) 470, a landing collar with a ball seat 472, a landing collar without a ball seat 474, a float collar 476, a liner joint or joints 478 and/or 480, a float shoe 482 and/or a reamer float shoe 484.

As an example, a method can include setting a liner hanger, releasing a running tool, cementing a liner and setting a liner top packer. As an example, a method can include pumping heavy fluid (e.g., cement) down an annulus from a point above a liner hanger and a liner top packer. In such an example, stress on a formation may be reduced when compared to a method that pumps heavy fluid (e.g., cement) up such an annulus. For example, stress may be reduced as back pressure developed during pumping may be contained in between a casing and a landing string.

As mentioned, a production well may experience a decline in production (e.g., production rate as a fluid flow rate). In such an example, one or more techniques, technologies, etc., may be utilized to assist and/or enhance production (e.g., consider one or more enhance oil recovery (EOR) approaches, etc.). As an example, artificial lift technology may be utilized to assist production of fluid(s) from a well that is in fluid communication with a reservoir. Artificial lift technology can add energy to fluid to enhance production of the fluid. Artificial lift systems can include rod pumping systems, gas lift systems and electric submersible pump (ESP) systems. As an example, an artificial lift pumping system can utilize a surface power source to drive a downhole pump assembly. As an example, a beam and crank assembly may be utilized to create reciprocating motion in a sucker-rod string that connects to a downhole pump assembly. In such an example, the pump can include a plunger and valve assembly that converts the reciprocating motion to fluid movement (e.g., lifting the fluid against gravity, etc.). As an example, an artificial lift gas lift system can provide for injection of gas into production tubing to reduce the hydrostatic pressure of a fluid column. In such an example, a resulting reduction in pressure can allow reservoir fluid to enter a wellbore at a higher flow rate. A gas lift system can provide for conveying injection gas down a tubing-casing annulus where it can enter a production train through one or more gas-lift valves (e.g., a series of gas-lift valves, etc.). As an example, an electric submersible pump (ESP) can include a stack of impeller and diffuser stages where the impellers are operatively coupled to a shaft driven by an electric motor. As an example, an electric submersible pump (ESP) can include a piston that is operatively coupled to a shaft driven by an electric motor, for example, where at least a portion of the shaft may include one or more magnets and form part of the electric motor.

Examples of artificial lift equipment can include a gas lift (GL) system, a rod pumping (RP) system, and an ESP system. Such equipment may be disposed at least in part in a downhole environment to facilitate production of fluid; noting that a pump system (e.g., RP and/or ESP) may be utilized to move fluid to a location other than a surface location (e.g., consider injection to inject fluid into a subterranean region, etc.). A gas lift system operates at least in part on buoyancy as injected gas may be expected to rise due to buoyancy in a direction that is opposite gravity; whereas, a RP or an ESP may operate via mechanical movement of physical components to drive fluid in a desired direction, which may be with or against gravity.

As explained, various types of equipment can be utilized for performing completions operations that aim to complete a well such that it is in an operable state for purposes of injection and/or production. As explained, where a well is a production well, over the course of time, when the production of fluid declines to an extent that it is deemed impractical for further operation of the well (e.g., with or without assist, EOR, etc.), a decision can be made to perform a plugging operation. As explained, one or more other factors may be considered in deciding whether or not to perform a plugging operation. A plugging operation can be a "plug cementing" operation that aims to form a plug that can be or include a substantially cylindrical portion that aims to hinder flow or fluid (e.g., be a barrier to fluid communication in a bore).

Where a decision has been made to perform a plugging operation, production tubing, if present, can be removed, and a determination can be made regarding condition of cement in one or more annuli. If cement is not deemed to be an acceptable condition, a process can include casing removal and cement removal. Where casing and annulus cement have been removed, a plugging operation can be utilized to fill or plug a portion of a borehole with cement in an effort to prevent inter-zonal and/or surface communication of the borehole (e.g., or at least a portion thereof). Removal of casing and annulus cement can be resource intensive and time consuming, particularly in offshore wellbores. Removal of casing and annulus cement can be relatively complicated and demand use of rig equipment for pulling the casing out of the wellbore.

As to a cement plug, a material such as Portland cement may be utilized, which can be placed in a well as a slurry that hardens in due time. A cement plug includes a volume of cement that fills a certain length of casing or open hole in an effort to hinder migration of fluid, which can be migration in a direction that is from downhole to uphole. Cement can satisfy criteria for an adequate plug as it tends to be durable with a low permeability. Furthermore, as slurry it tends to be relatively straightforward to pump into place while having a reasonable setting time. Cement tends to form a relatively tight bond to a formation and/or a casing surface. Cement can also has a sufficient mechanical strength under compression; noting that it tensile characteristics tend to be substantially weaker.

As an example, cement may be rated to perform over a range of temperatures, which may include temperatures from below freezing in permafrost zones to temperatures exceeding 400 C in geothermal wells. Cement manufacturers can produce special versions of Portland cement for use in wells. As an example, cement may include more than 100 cement additives to adjust cement performance, such that cement can be customized for a particular well environment.

A suitable cement may be formulated that is pumpable for a time sufficient for placement and development of strength within a suitable amount of time (e.g., within a number of hours after placement). As explained, a plug may be expected to be durable throughout its lifetime.

As to additives, they may be classified according to function. For example, accelerators can reduce cement setting time and increase rate of compressive strength development. Retarders can delay setting time and extend the time during which cement slurry is pumpable. Extenders can lower the cement slurry density, reduce the amount of cement per unit volume of set product, or both. Weighting agents can increase the density of the cement. Fluid loss control agents can aim to control leakage of water from the cement slurry into porous formations, thereby helping to preserve a designed cement slurry properties. Lost circulation control agents can aim to limit flow of cement slurry out of a wellbore into weak, cracked or vugular formations and help ensure that the cement slurry is able to fill a particular space. Dispersants can aim to reduce the viscosity of cement slurry, which may allow for a lower pumping pressure during placement. Specialty additives can include, for example, antifoam agents, fibers and flexible particles.

As an example, where the plug is to be set in a non-permeable portion of a formation (e.g., a shale layer, etc.), a formation-wellbore wall interface may be prepared by carving grooves into the wall that can permit liquid to escape as a material sets. As explained, a material may be cement or another suitable material such as, for example, a bismuth alloy, etc. As an example, a process can include forming helical grooves and/or vertical grooves connected by horizontal or angled grooves using, for example, a laser or other tool. As to length of a plug, consider a plug of the order of meters (e.g., consider 5 meters, etc.). As an example, one or more techniques, types of equipment, types of materials described in International Publication No. WO 2019/194844 A1, published 10 Oct. 2019, which is incorporated by reference herein, may be utilized for plugging operations and/or plug formation.

As an example, where a plug is to be set in a porous layer of a formation (e.g., a sandstone, etc.), the location of a cap rock (e.g., an impermeable layer) for that porous layer may be identified. In such an example, a barrier or shot-catcher may then be installed at a location in the porous layer and material deployed and set. As an example, a process can include applying pressure (e.g., through a setting mechanism, etc.) that can force material into the pores of a porous layer of a formation, which may aim to displace fluid such as, for example, brine at the formation-borehole interface into the formation.

As explained, a plug may be of a length that is of the order of meters while having a diameter that is less. For example, consider a plug that has a diameter that is less than a meter, which may be less than half of a meter. As an example, a plug can include a dendritic web portion that may extend one, two, or even a few centimeters away from its substantially cylindrical portion. As explained, a plug may be formed that aims to seal a portion of a borehole in a manner that can resist movement of fluid driven by a differential pressure.

Figure 5:
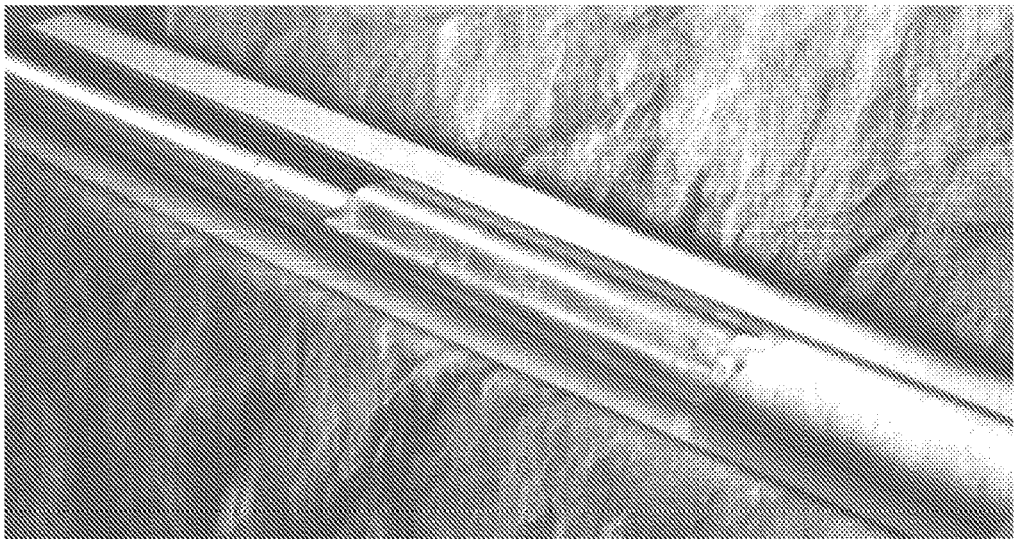
FIG. 5 illustrates an example of equipment in an environment and an example scenario with an example plot.
Figure 5:
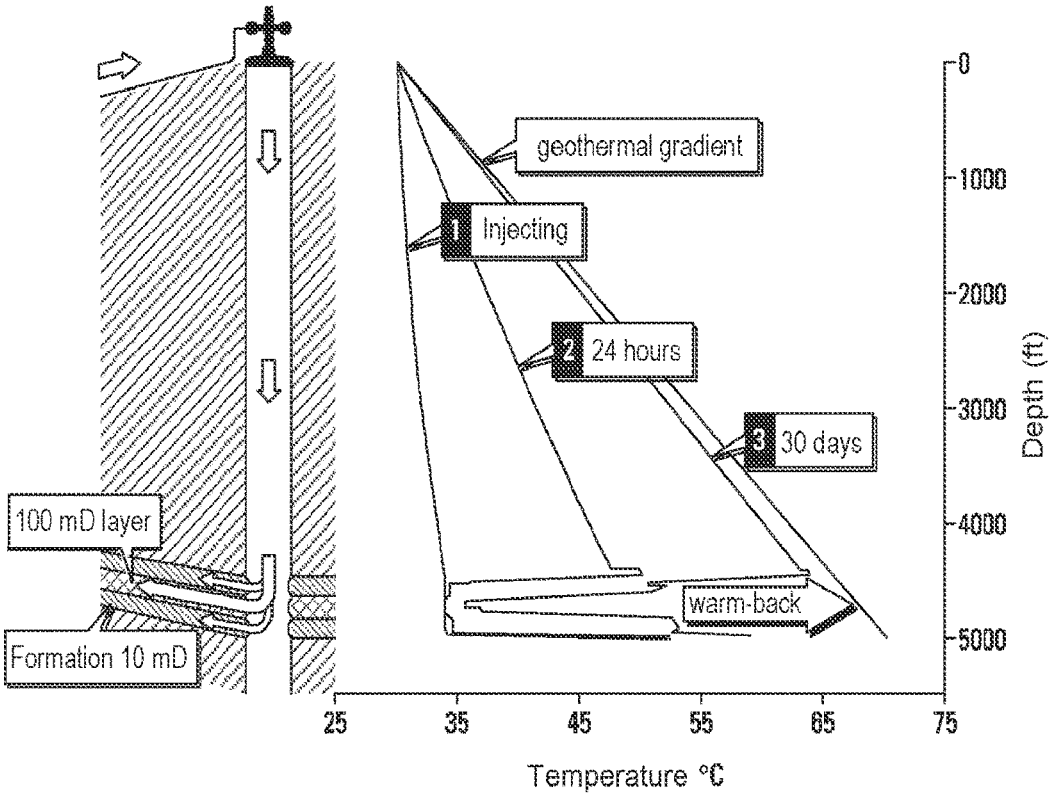

FIG. 5 shows an example schematic 510 of a plugging operation where equipment is disposed in a borehole for deposition of material therein, which can be a material such as, for example, cement, alloy, etc. FIG. 5 also shows an example scenario and plot 530 that is illustrated via a graphic of a bore within a formation where the plot is of temperature data versus a spatial dimension (e.g. depth). In the scenario, fluid is injected into the bore of the formation for a period of time, which may be, for example, of the order of days. During injection, the temperature of the bore (e.g., and sensor(s)) may be expected to be approximately that of the fluid being injected (e.g., as provided at the surface). Once injection is halted, heat from within the formation can warm regions of the bore and formation that were cooled by the injection fluid. As an example, for regions where little injection fluid has entered the formation, that amount of injection fluid may rise in temperature within a period of time of the order of hours (see, e.g., the 24 hour temperature profile); however, where larger amounts of injection fluid enter the formation (see, e.g., depths of about 4500 ft (about 1370 m) to about 5000 ft (about 1525 m)), temperature may rise more slowly, in a more extended period of time back toward the geothermal gradient (e.g., baseline temperature profile). FIG. 5 shows a 100 mD layer and surrounding formation at 10 mD. In the plot, the higher permeability 100 mD layer may take up an amount of injection fluid such that a temperature increase may occur more slowly compared to the surrounding formation at 10 mD, for example, even at 30 days, the temperature at the 100 mD layer remains close to that of the injection fluid. As an example, a method can include performing one or more analyses using downhole data acquisition equipment, etc., which may be utilized in determining one or more aspects of development, drilling, completions, plugging, etc.

A mentioned, as a reservoir matures and output levels change, oil and gas operators can reassess performance as to production. Depending on one or more factors, a decision may be made to plug a well using one or more plugs. For example, consider one or more of a log data-based determination that there is likely insufficient hydrocarbon potential to complete the well, a production-based determination that production operations have drained at least a portion of a reservoir (e.g., a drainage area), a safety-based determination that a risk may exist as to safe operation of the well, etc.

Performance of a plugging operation may aim to adhere to one or more standard operating procedures (SOPs), regulations, etc. To prepare a wellbore to be shut in and permanently isolated, there can be various regulatory demands associated with a plug and abandonment (P&A) process to ensure that various strata (e.g., freshwater aquifers, etc.) are adequately isolated. As an example, a process may include setting one or more cement plugs in a wellbore. Such a process can include performing an inflow or integrity test, which may be performed at one or more stages and aim to confirm hydraulic isolation.

As an example, regulations, SOPs, etc., may demand that cement plugs be placed and tested across one or more open hydrocarbon-bearing formations, across one or more casing shoes, across one or more freshwater aquifers, one or more areas near the surface (e.g., top 20 to 50 ft [6 to 15 m] of the wellbore), etc.

As an example, a process can include a plan that calls for setting one or more bridge plugs in conjunction with cement slurries to help assure that higher density cement does not fall in a wellbore. For example, a bridge plug can be set and cement pumped on top of the bridge plug, for example, through drillpipe where the drillpipe can be withdrawn before cement slurry thickens.

As an example, a workflow can include preparing a well for P&A by circulating high density drilling fluid and installing a deep set mechanical plug, before barriers towards a reservoir are installed. In the North Sea, a workflow can include two independent barriers towards the reservoir (NORSOK D-010, 2013), where the primary and secondary barriers are not to have common well barrier elements. In such an example, fluid-bearing formations in the overburden, such as high-pressure zones and one or more hydrocarbon-containing formations can also be isolated, for example, with two independent barriers. In such an example, an openhole-to-surface plug (e.g., an environmental barrier) can be installed below a seabed, which aims to prevent residual fluid contamination to the environment. As an example, a workflow can include removal of the conductor and wellhead.

According to Oil & Gas UK, a workflow can include an operational sequence of P&A operations that include three phases where: Phase 1 is defined as "reservoir abandonment" and includes installing primary and secondary barriers towards the reservoir; Phase 2 is defined as "intermediate abandonment" and includes installing potential barriers towards flow zones in the overburden and the surface plug; and Phase 3 is defined as "wellhead and conductor removal" and includes cutting and retrieval of casing strings and conductor, as well as wellhead removal. In addition to these three phases, a fourth phase may be included, which may be a Phase 0 "preparatory work", which includes pre-P&A work such as killing the well and installing deep set mechanical plugs.

Figure 6:
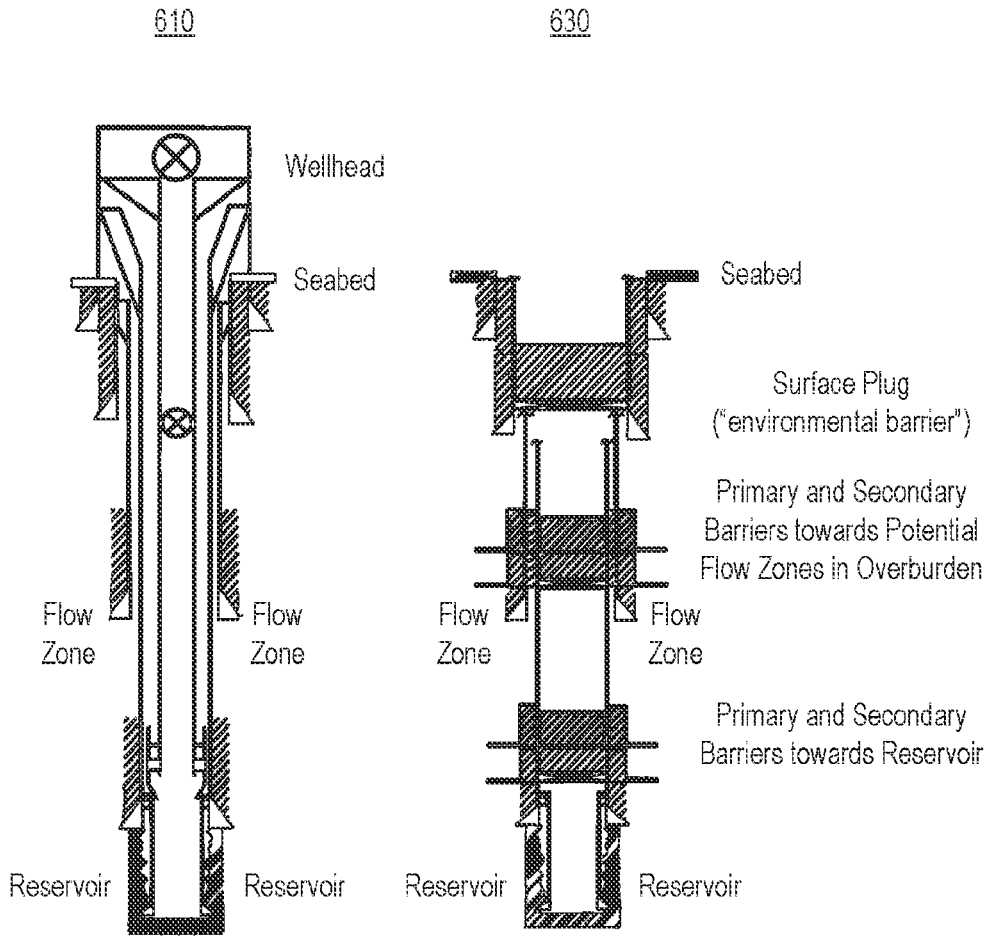
FIG. 6 illustrates examples of equipment in an environment.

FIG. 6 shows an example schematic of a well 610 that includes a wellbore that extends through a flow zone and into a reservoir where wellhead equipment is installed at the seabed. FIG. 6 also shows an example schematic of the well 610 in a plugged state 630. As shown, the wellhead equipment has been removed at the seabed and, from bottom to top, primary and secondary barriers are installed in a position toward the reservoir, primary and secondary barriers are installed towards one or more potential flow zones in the overburden (overburden with respect to the reservoir), and a surface plug, which may be referred to as an environmental plug.

As explained, a plug can be installed to perform one or more tasks of one or more workflows, which may include a P&A workflow or another type of workflow. As an example, a method can be utilized for quantifying a leak rate across an impermeable plug placed in a well prior to abandonment of the well. In such an example, data may be acquired from a deployable pressure sensor above a plug.

As to such a method, three example scenarios can include: (i) liquid column rests below a gas column in communication with atmosphere, (ii) liquid column is below a sealed gas column, and (iii) substantially the entire length of the wellbore is filled with liquid, which may be brine (e.g., primarily brine).

As an example, a method can account for the influence of temperature and pressure on one or more gas properties, which can be or include density as a gas property. For liquid, there can be an effect due to temperature. As to pressure and temperature effects in liquid, both of these can be relevant particularly for long liquid-column wells with a minimal geothermal gradient. As an example, a method can include assessing thermal information to determine how a geothermal gradient may affect a determination that may not account for pressure effects in liquid in addition to temperature effects. As an example, where geothermal gradients are less than a particular level (e.g., 10 degrees C. per km or less, etc.), density variation due to a liquid column's gravitational head may be comparable to that due to temperature or even exceed it.

As an example, a method can, from measured pressure above a plug, compute a leak rate and, for example, permeability of one or more leakage pathways. As an example, a method can include computing a pressure below a plug and, as appropriate, a time dependency of pressure below the plug.

At the end of the life cycle of an oil or gas well, which may depend on one or more factors, a P&A process can include robust plug placement. In various examples, where the original cement isolation is deemed to be imperfect, after removing the tubing and casing, a long column of cement of more than approximately 200 m may be placed. Such a process can be relatively expensive as it involves use of a rig and does not guarantee that the cement plug remains pristine (e.g., of sufficient integrity). Additionally, as the tensile strength of cement tends to be relatively low, deformation of a wellbore that places a plug under tension may lead to cracking (e.g., crack formation). For various reasons, a substitute for deploying reliable and strong plugs can be desirable. As an alternative to cement, a P&A workflow may utilize one or more bismuth based alloys.

As an example, a method can provide for monitoring leak rates into a fluid column of a wellbore by acquiring sensor-based measurements of pressure in a location above a plug. As an example, a method may address one or more scenarios, which can include: (i) a partially liquid filled wellbore with the gas column in pressure communication with the atmosphere; (ii) a partially filled wellbore with the gas column isolated from the atmosphere; and (iii) a substantially fully liquid filled wellbore. The behavior and the requisite models for interpretation of pressure and leakage rates in the three scenarios tend to be different from each other.

As mentioned, a method can aim to quantify a leak rate for a plug (e.g., or plugs). Such a method may also provide an estimate of a pressure drive below a plug, which may be obtained from measurements above the plug. Such a method may also determine variation in pressure such as, for example, determining that a slowly varying bottom pressure exists, which may be characterized. As an example, output from a method (or methods) can allow for making one or more determinations as to plug integrity, for example, for instances where the bottom pressure varies slowly, compared to the time scales above the plug.

As an example, where a leak rate is sufficiently small with respect to a plug in a wellbore, a method may aim to quantify influx through the plug in the wellbore. Such a method may be carried out from a limited set of measurements, as the integrity of the plug can be paramount in that cable based communication to a fluid region below the plug can compromise plug integrity. In various instances, wireless transfer of data from a transducer below the plug through a 5 m conductive plug may be impractical for one or more reasons (e.g., placement, duration of operation, ability to communicate, etc.). As an example, a method can include positioning a single-station pressure measurement unit above a plug and acquiring measurements from the single-station pressure measurement unit where the acquired measurements can be utilized to computer a leak rate and, optionally, pressure below the plug. As mentioned, leak rate and/or pressure below a plug may be computer with respect to time to understand time varying behavior.

Figure 7:
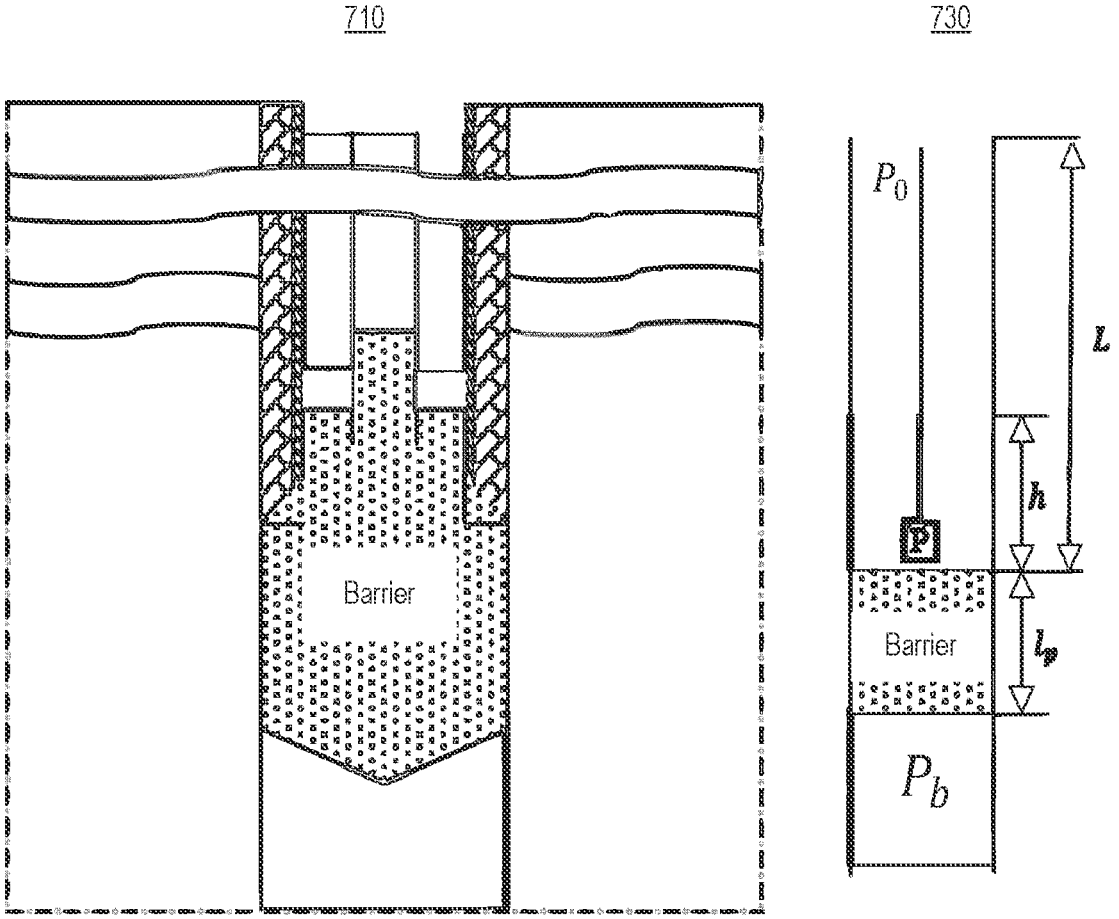
FIG. 7 illustrates examples of equipment in an environment.

FIG. 7 shows an example schematic 710 and an example schematic 730. As to the schematic 710, it shows a wellbore plugged with alloy at a caprock section. For plug integrity assurance, as explained, feeding a cable or having a cable sleeve for accessing fluid below the plug may compromise integrity of the plug. As explained, a method can include computing leakage from measurements above a plug, which can be performed in a manner with using a cable that extends from a region above the plug to a region below the plug. If a cable was utilized to communicate with a pressure sensor below the plug, a pressure differential may be determined from which leakage may be inferred; however, if the plug is compromised due to the presence of the cable, the cable itself may be a cause of leakage (e.g., deterioration in integrity of the plug, etc.).

In FIG. 7, the schematic 730 shows various parameters, including a pressure $P_0$, a pressure sensor P, a length L, a plug length $l_p$, and a dimension h. As mentioned, a simultaneous indicator of pressure below a plug $P_b$ and its variation with time can be desirable.

Figure 8:
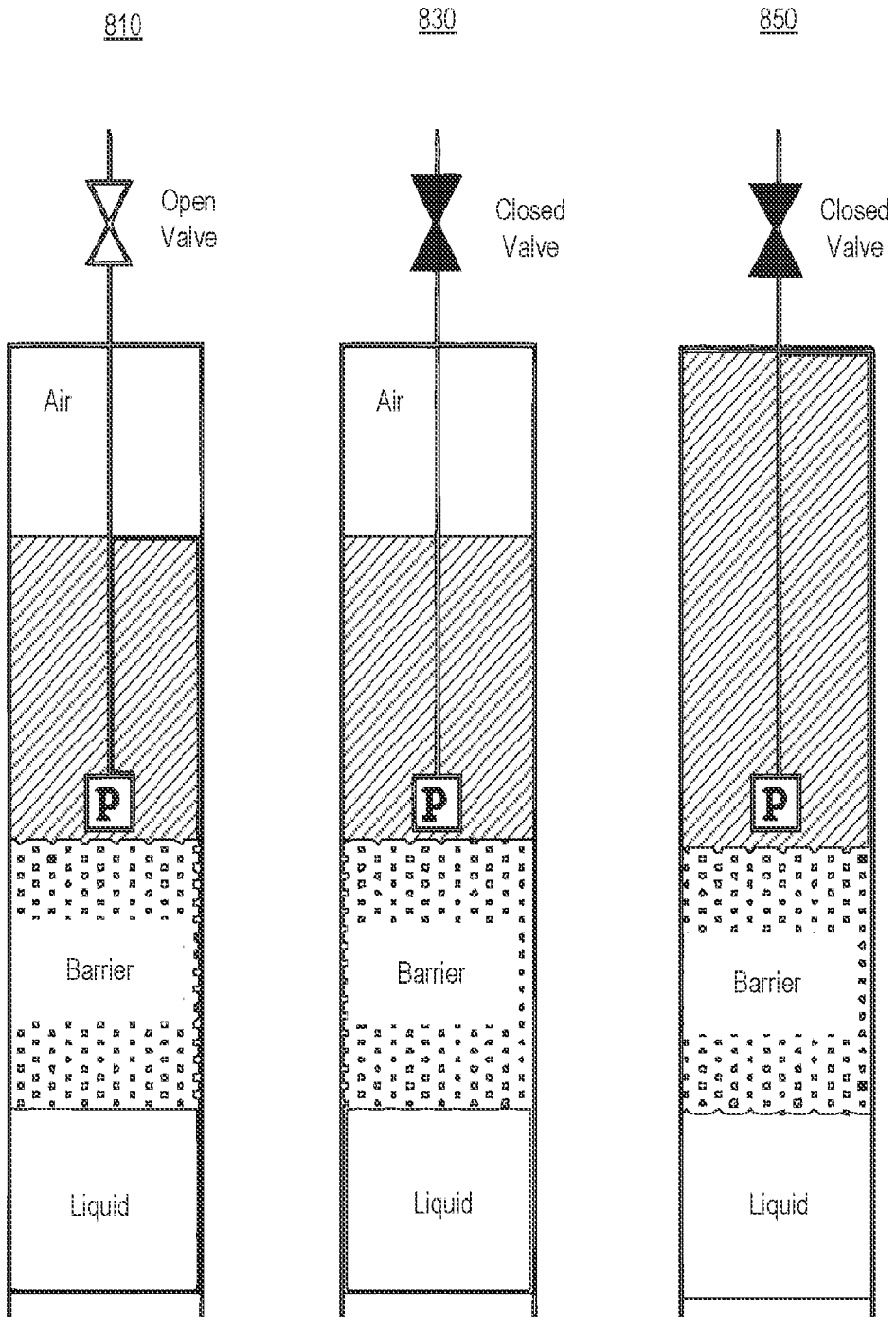
FIG. 8 illustrates example scenarios.

FIG. 8 shows schematic examples of three configurations 810, 830 and 850. In the configuration 810, a plug is set in a wellbore with a brine column above which is an air or gas column in the wellbore that is in pressure communication with atmosphere (see, e.g., open valve). In the configuration 830, a plug is set in a wellbore with a brine column above which is an air column that is within the wellbore that is isolated from atmosphere (see, e.g., closed valve). In the configuration 850, a plug is set in a wellbore below a brine column, where the brine column reaches to the top and where the fluid is isolated (see, e.g., closed valve).

In the example configurations 810, 830 and 850, a method or methods may be implemented to make one or more determinations as to leakage and optionally variations in pressure below the respective plugs. In the configurations, 810, 830 and 850, the governing equations can differ. As an example, a method can allow for temperature induced density variation in a liquid column (e.g., as a sole type of variation in the liquid column) and include temperature and pressure effects for the gas column (e.g., more effects in the gas column than in the liquid column). As an example, over a 1000 m column height, a temperature change may be approximately about 25 degrees C. In such an example, the corresponding decrease in brine density is about 1.25 percent at a mean temperature of about 55 degrees C. Over the same liquid column, the pressure change is about 10 MPa. In such an example, the density increase is about 0.4 percent; therefore, as a first approximation, pressure influence may be dropped.

As to a communicating borehole, neglecting variations in atmospheric pressure, a wellbore air column can be at a substantially constant pressure at the top. As noted, a method can take into account the variation of density with respect to pressure and temperature for the air column; whereas, for a liquid column, a method may optionally be limited to temperature related variations as to liquid density determinations. However, where temperature information indicates that a temperature gradient may be less than a particular value (e.g., over a particular length or lengths), a method may account for pressure and temperature in a liquid column.

Various examples of computations can be described using various parameters, which may be notated as follows: top of the plug is the vertical coordinate's origin (z=0). The height of the wellbore from that point is L. The height of a liquid column at a given time t is h, which is a function of time $\tilde{h}(t;\bullet)$ that may be represented as $\tilde{h}(t)$. At z=h, pressure is $P_i$. Gas pressure is $P_g$ and liquid pressure is $P_\ell$. Pressure at the top of the plug is $P_t$. The liquid pressure $P_t$ changes with h, and therefore can vary with t. At z=h, $P_g=P_\ell=P_i$. Atmospheric pressure is $P_0$. Additionally, the cross-sectional area of the wellbore is A. Liquid and gas densities are $\rho_\ell$ and $\mu_g$.

Since a leakage rate tends to be of a relatively small magnitude, leak induced flow can cause a pressure gradient to be substantially smaller than that of $\rho_\ell g$ or $\rho_g g$, g being the acceleration due to gravity. Gradient in pressure, can therefore be dictated by statics. Then, for an ideal gas, $$P_g(z) = P_0 + \int_Z^L \left(\frac{P_g(z)M_w g}{RT}\right)dz$$

where $M_w$ is the molecular weight of the gas in the column, R is the gas constant, and T is the temperature.

As mentioned, depending on circumstances (e.g., environmental conditions, etc.), a method can account for fluid density variation in a bore uphole of a plug where such fluid can include liquid and may include gas. For example, depending on circumstances, a method can include accounting for density variation in gas with respect to pressure and temperature and in liquid with respect to temperature (e.g., a temperature induced density change in a liquid column).

Where geothermal gradients are less than a particular level (e.g., 10 degrees C. per km or less), density variation due to a liquid column's gravitational head may be comparable to that due to temperature or even exceed it. Under such conditions, a method may utilize pressure measurements from above a plug, to determine a leak rate through the plug and a bore (e.g., a plugged system), optionally along with pressure below the plug.

As an example, a method can include performing computations associated with a perturbation solution.

As an example, a method can include assessing conditions to determine a type of scenario. For example, consider scenarios that can include: (i) liquid column rests below a gas column in communication with atmosphere, (ii) liquid column is below a sealed gas column, and (iii) the entire wellbore is filled with liquid (e.g., brine, etc.). In such an example, a method can include providing one or more of (a) leak rate, (b) an initial driving pressure below a plug, and (c) a slow variation of the driving pressure in a non-quiescent reservoir.

As an example, a method can be utilized to monitor leak rates into a fluid column of wellbore by observing pressure above the plug for one or more types of scenarios. For example, consider one or more of: (i) a partially liquid filled wellbore with the gas column in pressure communication with the atmosphere; (ii) a partially filled wellbore with the gas column isolated from the atmosphere; and (iii) a fully liquid filled wellbore, which may be subdivided into open and closed surface valving. As explained herein, behavior and computational models that can utilize pressure for computing leakage rates in the three foregoing scenarios can differ. As explained, depending on conditions, a method may utilize temperature induced density variation of the liquid in a column where compressibility effects are not considered in the liquid as it may be assumed that a geothermal gradient induced variation is much stronger than that due to pressure change caused by a nearly static column. However, where such considerations do not hold or otherwise introduce unacceptable error, one or more relationships and/or computational approaches may be altered.

As an example, rather than utilizing an exact solution, a suitable approximation may be obtained for a pressure gradient in a wellbore, for example, by recognizing that the fractional volume change due to characteristic pressure (P) and temperature (T) changes is small compared to unity. For scenarios where the isothermal compressibility and volume expansivity may be approximated as a constant evaluated at mean T and P, a first order adjustment due to varying density in liquid may be obtained.

As to liquid pressure, as shown in FIG. 7, h is the height of liquid at a given time, and excluding its parametric dependence, consider $h=\hat{h}(t)$. Pressure at the top of a plug can vary with t and is $P_t$ ($=P_{\ell t}$; since top of plug is maintained in contact with liquid) and at h, it is $P_i$, again varying with time. In such an approach, the corresponding temperatures can be labeled as $T_t$ and $T_i$. Acceleration due to gravity is g and densities can be denoted as p, with the subscripts indicating liquid ($\ell$) or gas (g). A vertical coordinate z can point upwardly (e.g., away from a top of a plug, etc.). In various example methods, computations can provide for a solution to liquid pressure for given z and t within a column.

Consider, for example:

$$P_t = P_{\ell t} = P_i + g\int_0^h \rho_\ell dz, \tag{1}$$

where $\rho_\ell=\hat{\rho}_\ell(P, T)$.

As an example, consider an assumption that though the density may decrease with depth (decreasing $z$), natural convection induced by it is local, and large scale convection over the depth of a well can be inconsequential. Thus, density can be determined by local pressure and environmental temperature, and a column can be in hydrostatic equilibrium. A flow velocity induced by a leak itself may be expected to be small enough such that its influence on a pressure gradient within a wellbore may be neglected.

As an example, consider $\hat{\rho}_\ell(P, T)$ as defining isothermal compressibility c and volume expansivity κ through $$c = \frac{1}{\rho_\ell}\frac{\partial \rho_\ell}{\partial P}, \tag{2}$$

and $$\kappa = -\frac{1}{\rho_\ell}\frac{\partial \rho_\ell}{\partial T}. \tag{3}$$

Therefore, $$d\rho_\ell = c\rho_\ell dP - \kappa\rho_\ell dT. \tag{4}$$

As an example, a method can consider using a first order adjustment where, for example, c and κ can be assigned values based on an expected mean value of T and P over a liquid column. In such an example, if appropriate, a first pass approximation may be performed with constant $\rho_\ell$ and it may, as appropriate, be improved, for example, after estimating $\min(P_i)$ and $\min(T_i)$ over the liquid column and taking the suitable pressure for c and κ to be at $[\min(P_i)+\max(P_t)]/2$ at a temperature of $[\min(T_i)+T_t]/2$.

As an example, an estimate for $\min(T_i)$ can be based on a maximum height over a time interval of interest, where, for example, a first pass of which can again be estimated using a constant $\rho_\ell$ (see, e.g., Appendix).

As to a first order adjustment, assuming a procedure as set forth in the Appendix, which is part of this application, it can provide c and κ. Proceeding, it can be useful to define a pressure $\rho_{\ell 0}$, through:

$$\rho_{\ell t}=\hat{\rho}_\ell(P_{\ell 0}, T_t), \tag{5}$$

where $P_{\ell 0}:=\rho_{\ell t}gL$.

In such an example, the reason for the pressure scale choice can be discerned in consideration of the description that follows. The foregoing provides an implicit equation for $P_{\ell 0}$ or $\rho_{\ell t}$, but may be determined prior to acquiring a measurement, for example, by solving Eq. 5. At a given temperature, $\rho_\ell$ (e.g., consider brine) tends to be substantially linear with respect to pressure, and therefore solving Eq. 5 can be relatively straightforward.

Integrating $\rho_\ell$, the first order adjustment equation for $\rho_\ell$ can be represented as:

$$\rho_\ell=\rho_{\ell t}[1+c(P_\ell-P_{\ell 0})-\kappa(T-T_t)]+ \tag{6}$$

Based on a geothermal gradient α, $T=T_t-\alpha z$. Thus, $$\rho_\ell=\rho_{\ell t}[1+c(P_\ell-P_{\ell 0})+\alpha\kappa z]+ \tag{7}$$

Note that $P_{\ell 0}$ is the scale for $P_\ell$. Now consider the magnitudes of c and κ are such that:

$$cP_{\ell 0}<<1;\alpha\kappa L<<1. \tag{8}$$

As an example, a method may consider terms below a certain order (e.g., may ignore one or more higher order terms). As to a first order adjustment, consider:

$$\zeta = \frac{z}{L}; \xi = \frac{P_\ell}{\rho_{\ell t}gL}; \varepsilon = cP_{\ell 0} \ll 1; \delta = \alpha\kappa L \ll 1. \tag{9}$$

Within a liquid column, consider the equation of static equilibrium, $$\frac{\partial P_\ell}{\partial z} = -\rho_\ell g = -\rho_{\ell t}g[1 + c(P_\ell - P_{\ell 0}) + \alpha\kappa z] + \ldots \tag{10}$$

With the definitions of Eq. 9, this amounts to:

$$\frac{\partial \xi}{\partial \zeta} = -[1 + \varepsilon(\xi - 1) + \delta\zeta] + o(\varepsilon) + o(\delta). \tag{11}$$

Above, note that ξ may vary with time, due to change in h, but at a given instant, static equilibrium can be maintained. Consider a solution of the form of:

$$\xi = \xi_0 + \delta\xi_1 + \varepsilon\xi_2 + \ldots \tag{12}$$

A solution for dimensional pressure can equal $P_t=\hat{P}_t(t)$ at $\zeta=0$. Consider that $\mathcal{O}(1)$ implies:

$$\frac{\partial \xi_0}{\partial \zeta} = -1, \tag{13}$$

and therefore $\xi_0=-\zeta+D_1(t)$. Applying this at $\zeta=0$, $$\xi_0 = -\zeta + \frac{P_t}{\rho_{\ell t}gL}. \tag{14}$$

At $\mathcal{O}(\delta)$:

$$\frac{\partial \xi_1}{\partial \zeta} = -\zeta. \tag{15}$$

-continued

Then, $$\xi_1 = -\frac{\zeta^2}{2} + D_2(t). \tag{16}$$

Based on the $\zeta=0$ condition, $D_2(t)=0$. From $\mathcal{O}(\varepsilon)$, $$\frac{\partial \xi_2}{\partial \zeta} = 1 - \xi_0 = 1 + \zeta - \frac{P_t}{\rho_{\ell t} g L}, \tag{17}$$

and therefore, $$\xi_2 = \zeta + \frac{\zeta^2}{2} - \frac{P_c}{\rho_{\ell t} g L}\zeta + D_3(t). \tag{18}$$

As explained, above, the $\zeta=0$ condition means that $D_3(t)=0$. A full solution may be expressed as:

$$\xi = -\zeta + \frac{P_t}{\rho_{\ell t} g L} - \delta\frac{\zeta^2}{2} + \varepsilon\zeta + \varepsilon\frac{\zeta^2}{2} - \varepsilon\frac{P_t}{\rho_{\ell t} g L}\zeta. \tag{19}$$

And, in dimensional form:

$$P_\ell = -P_{\ell 0}\frac{z}{L} + P_t - \frac{\alpha\kappa P_{\ell 0} z^2}{2L} + \frac{c P_{\ell 0}^2 z}{L} + \frac{c P_{\ell 0}^2 z^2}{2L^2} - \frac{c P_t P_{\ell 0} z}{L}. \tag{20}$$

Above, from measured $P_t$, $P_\ell$ provides $P_i$, pressure at the interface by replacing z with h in Eq. 20. Thus, in such an approach, this information is sufficient to deal with multiple scenarios of open and closed borehole both with a gas column, and without a gas column.

Again, FIG. 8 shows three example scenarios or configurations 810, 830 and 850. The scenario 810 is a communicating borehole case, the scenario 830 is a sealed one, and the scenario 850 is a filled borehole. Common among the three scenarios 810, 830 and 850 is the liquid pressure varying with z and t; noting that the scenarios 850 can be treated somewhat differently from the scenarios 810 and 830.

As to a communicating borehole, from static equilibrium in an ideal-gas column with a geothermal gradient of $\alpha$, and molecular weight $M_w$, consider:

$$\frac{\partial P_g}{\partial z} = -\frac{P_g M_w g}{R[T_0 + \alpha(L - z)]}. \tag{21}$$

Integrating with respect to z and applying the boundary condition that at z=L, $P_g=P_0$, the atmospheric pressure, and the extrapolated seasonally invariant temperature profile to the surface provides $T_0$, consider:

$$P_g = P_0\left[\frac{T_0 + \alpha(L - z)}{T_0}\right]^{\frac{M_w g}{\alpha R}}. \tag{22}$$

The interface pressure from $P_g$ is $$P_i = P_0\left[\frac{T_0 + \alpha(L - h)}{T_0}\right]^{\frac{M_w g}{\alpha R}}. \tag{23}$$

Equating $P_g$ and $P_\ell$ at z=h, consider the relationship between $P_t$ and h being valid for a given time, and is:

$$P_0\left[\frac{T_0 + \alpha(L - h)}{T_0}\right]^{\frac{M_w g}{\alpha R}} = -P_{\ell 0}\frac{h}{L} + P_t - \frac{\alpha\kappa P_{\ell 0} h^2}{2L} + \frac{c P_{\ell 0}^2 h}{L} + \frac{c P_{\ell 0}^2 h^2}{2L^2} - c\frac{h}{L}P_t P_{\ell 0}. \tag{24}$$

The above approach can lead to:

$$h=\hat{h}(t;a), \tag{25}$$

from the measured $P_t$ at given times t, where there is an added a to the argument representing a vector of parameters, such as $T_0$, $\alpha$, $\gamma=-\kappa\rho_{\ell 0}$, c, etc., and omitted otherwise from the argument list.

As $\rho_\ell$ can vary with pressure and temperature in a substantial manner due to presence of a geothermal gradient that is relatively small (see, e.g., above as to 10 degrees C. per km, etc.), solving for the liquid density allows for computation of $M_\ell$, which is the mass of liquid where its variation in time may be related to the measured $P_t$.

For example, consider:

$$\rho_\ell = -\frac{1}{g}\frac{\partial P_\ell}{\partial z}. \tag{26}$$

Using Eq. 20, the above equation amounts to:

$$\rho_\ell = -\frac{1}{g}\left[-\frac{P_{\ell 0}}{L} - \frac{\alpha\kappa P_{\ell 0} z}{L} + \frac{c P_{\ell 0}^2}{L} + \frac{c P_{\ell 0}^2 z}{L^2} - \frac{c P_t P_{\ell 0}}{L}\right] \tag{27}$$

Using the definition for $P_{\ell 0}$, this is:

$$\rho_\ell = \rho_{\ell t}\left[1 + \alpha\kappa z - c P_{\ell 0} - c P_{\ell 0}\frac{z}{L} + c P_t\right]. \tag{28}$$

As noted, mass of the liquid within the column can vary with t. For example, for a wellbore of area A:

$$M_\ell = -A\int_h^0 \rho_\ell dz, \tag{29}$$

which, from Eq. 28, leads to:

$$M_\ell = A\rho_{\ell t}\left[h + \alpha\kappa\frac{h^2}{2} - c P_{\ell 0} h - \frac{c P_{\ell 0} h^2}{2L} + c P_t h\right]. \tag{30}$$

As $\rho_{\ell t}$ is not the density at the top of the plug but is dictated by $P_{\ell 0}$, an approach can set the density at the top of the plug as $\rho_{\ell tt}$. Consider a linear representation of this as:

$$\rho_{\ell tt}=\rho_{\ell t}+c(P_{\ell t}-P_{\ell 0})\rho_{\ell t}. \tag{31}$$

From $M_\ell$, a method can include inferring that:

$$P_{\ell t} = P_i + g\rho_{\ell t}\left[h + \frac{\alpha\kappa h^2}{2} - cP_{\ell 0}h - cP_{\ell 0}\frac{h^2}{2L} + cP_t h\right]. \tag{32}$$

or $$P_t(1 - cgp_{\ell t}h) = P_{\ell t}(1 - cg\rho_{\ell t}h) = P_i + g\rho_{\ell t}\left[h + \frac{\alpha\kappa h^2}{2} - cP_{\ell 0}h - cP_{\ell 0}\frac{h^2}{2L}\right]. \tag{33}$$

As to a leak rate, in the absence of mass exchange between liquid and gas in a column, the rate of change of mass in the column can be taken to be equal to the leak mass rate. In such an example, consider:

$$q = \frac{1}{\rho_{\ell tt}}\frac{dM_\ell}{dt}, \tag{34}$$

and therefore, $$q = A\frac{p_{\ell t}}{p_{\ell tt}}\left[\frac{dh}{dt} + \alpha\kappa h\frac{dh}{dt} - cP_{\ell 0}\frac{dh}{dt} - \frac{cP_{\ell 0}h}{Ld}\frac{dh}{dt} + cP_t\frac{dh}{dt} + ch\frac{dP_t}{dt}\right]. \tag{35}$$

As an example, a method can include acquiring relatively continuous pressure measurements (e.g., at a particular sampling rate over a period of time). For example, a relatively continuous measurement of $P_t$ can provide for inferring q as h can be known from $P_t$. By assigning a permeability to a plug of $k_p$, area of leakage pathway of $a_p$, length of pathway of $l_p$, for a fluid of viscosity p, and for a small leak rate:

$$q = \frac{k_p a_p}{\mu l_p}\left[P_b - P_t - p_{\ell tt}gl_p\right] := C\left[P_b - P_t - p_{\ell tt}gl_p\right]. \tag{36}$$

The results of Eq. 35 and Eq. 36 when equated permit for computing C and, therefore, the leak rate via Eq. 36, provided a value or values for $P_b$ can be estimated, known, etc. As an example, consider letting E be a small parameter (e.g., different from ε) so that ∈t is a relatively slow time. Given the foregoing, consider:

$$P_b = P_{b0} + P_{b1}(\in t), \tag{37}$$

where $P_{b1}(\in t)$ represents a slow variation in time of $P_b$, and $P_{b0}$ is a constant.

In such an example, the following can hold:

$$P_{b0} = \lim_{t\to 0}\left[P_t + q/C + p_{\ell tt}gl_p\right]. \tag{38}$$

Thus, by generating a plot of $P_t$ vs. q derived from Eq. 35, early time data can be expected to be asymptotic to define an asymptote to a straight line with a slope of −1/C and an intercept of $P_{b0}$. With C determined, consider defining $P_{t0}$ as:

$$P_{t0} = -\frac{A}{C}\frac{\rho_{\ell t}}{\rho_{\ell tt}}\left[\frac{dh}{dt} + \alpha\kappa h\frac{dh}{dt} - cP_{\ell 0}\frac{dh}{dt} - \frac{cP_{\ell 0}h}{Ld}\frac{dh}{dt} + cP_t\frac{dh}{dt} + ch\frac{dP_t}{dt}\right] + P_{b0} - p_{\ell tt}gl_p. \tag{39}$$

In such an example, the varying bottom pressure can be:

$$P_{b1}(\in t) = P_t - P_{t0}. \tag{40}$$

Above, note that on right hand side both terms vary with t but the difference tends to vary slowly with time.

Figure 9:
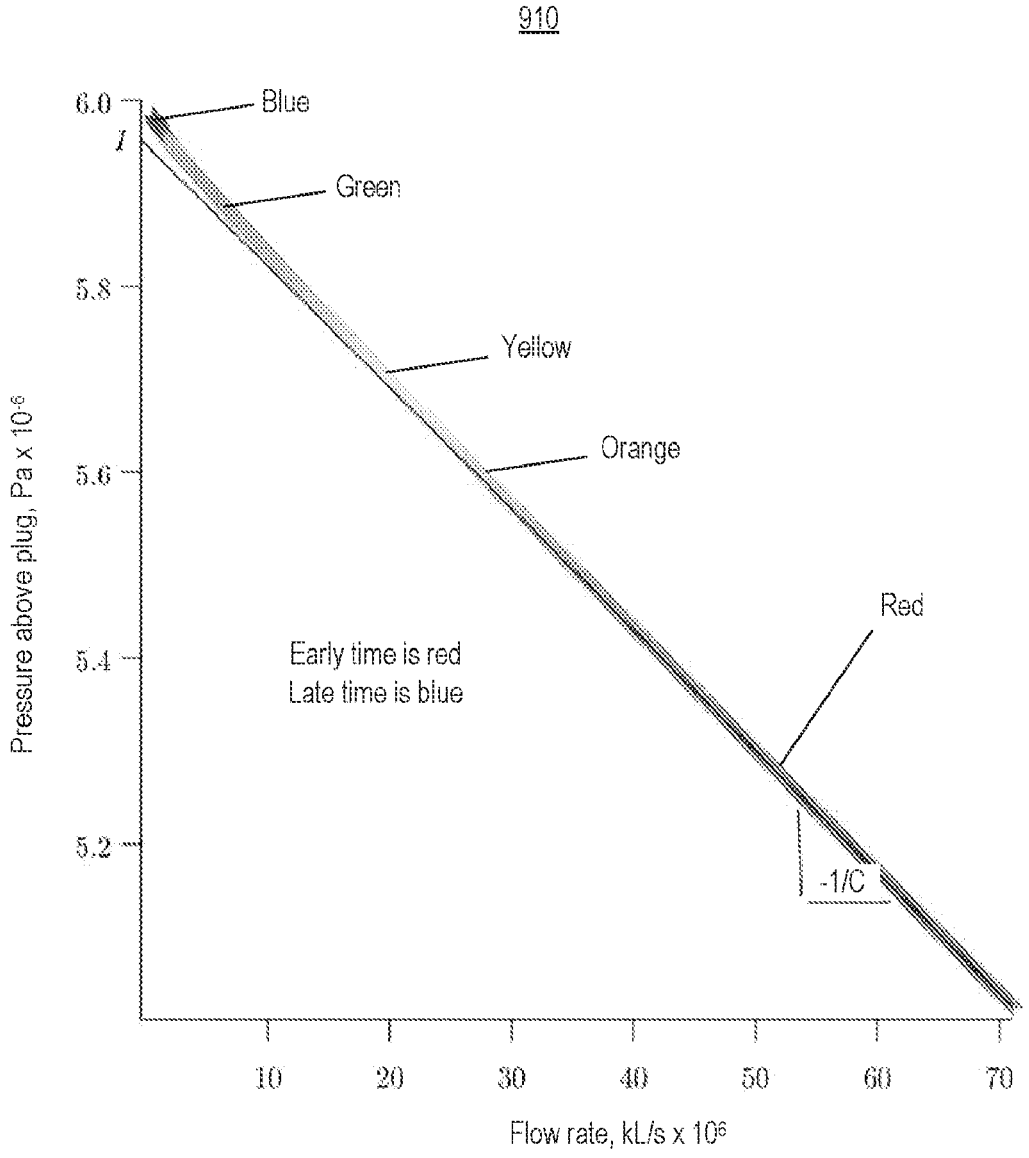
FIG. 9 illustrates an example plot.

FIG. 9 shows an example plot 910 where, for example, the intercept from zero-time extrapolation gives $P_{b0}$. In such an example, the difference between the "measured" value $P_t$ and the straight-line asymptote of early time data is $P_{b1}$. As explained, it can tend to vary slowly with time, for example, in relation to background variation of the asymptote.

As to a sealed borehole that is not in pressure communication with atmosphere, such as in the scenario 830, unlike in the communicating case (see, e.g., the scenario 810), where the pressure at the top for obtaining a profile from an equation of state, in the scenario 830 there is an unknown pressure boundary.

As an example, a method can include an ability to obtain an initial pressure within a gas region at the top and at the interface, where mass conservation may be used. Thus, mass of gas in a well from z=h=$\hat{h}$(t) to L can be expressed as:

$$M_g = \left[\hat{P}_i(t) - \hat{P}_L(t)\right]\frac{A}{g}, \tag{41}$$

where the symbols $\hat{P}_i(t)=P_i$ and $\hat{P}_L(t)=P_L$ serve to indicate that they are functions of time.

Above, the subscript L indicates pressure at z=L. When there is no interphase mass transfer, consider:

$$M_g = \left[\hat{P}_i(0) - \hat{P}_L(0)\right]\frac{A}{g}, \tag{42}$$

i.e., $M_g$ can be a constant. However, $M_g$ at given times can also be expressed by (see also Eq. 21):

$$M_g = A\int_{h=\hat{h}(t)}^{L}\rho_g dz = A\int_{h=\hat{h}(t)}^{L}P_g\frac{M_w}{R[T_0 + \alpha(L-z)]}dz, \tag{43}$$

where, in the second integral, a method can include making an assumption that gas is an ideal gas.

As explained, a method can have temperature imposed by a geothermal gradient, whereby, for example:

$$T = T_0 + \alpha(L - z), \tag{44}$$

where, $T_0$ can be the extrapolated temperature at z=L using, for example, a nonseasonal temperature profile (e.g., temperature information).

As an example, for given z and t, using Eq. 43 for mass in the column, from a force balance under static conditions:

$$P_g = \hat{P}_L(t) - g\int_L^z \frac{P_g M_w}{R[T_0 + \alpha(L-z)]}dz. \tag{45}$$

The differential version of the foregoing expression can be the static equation (see Eq. 21), which when integrated leads to:

$$P_g = F(t)[T_0 + \alpha(L-z)]^{\frac{gM_W}{\alpha R}}, \tag{46}$$

Above, F(t) can be arising as a result of integration. Applying the above at z=L:

$$F(t) = \frac{\hat{P}_L(t)}{T_0^{\frac{gM_W}{\alpha R}}}. \tag{47}$$

Thus, a solution in terms of a pressure at the top can be expressed as follows:

$$P_g = \hat{P}_L(t)\left[\frac{T_0 + \alpha(L-z)}{T_0}\right]^{\frac{gM_W}{\alpha R}}. \tag{48}$$

With z=h in Eq. 48, it is possible to obtain $P_i$ from $P_g$. Consider using Eq. 43:

$$M_g = \hat{P}_L(t)\left\{\left(\frac{T_0 + \alpha(L-h)}{T_0}\right)^{\frac{gM_W}{\alpha R}} - 1\right\}\frac{A}{g}. \tag{49}$$

Given the above, consider expressing the interface pressure in terms of $M_g$ as:

$$P_i = \hat{P}_i(t) = \frac{M_g g}{A}\left[1 - \left\{\frac{T_0}{T_0 + \alpha(L - \hat{h}(t))}\right\}^{\frac{gM_W}{\alpha R}}\right]^{-1}. \tag{50}$$

An explicit solution for $P_i$ is thus known from an initial condition.

Similar to $P_i$ from $P_g$, from $P_\ell$ of Eq. 20:

$$P_i = -P_{\ell 0}\frac{h}{L} + P_t - \frac{\alpha\kappa P_{\ell 0}h^2}{2L} + \frac{cP_{\ell 0}^2 h}{L} + \frac{cP_{\ell 0}^2 h^2}{2L^2} - \frac{cP_t P_{\ell 0} h}{L}, \tag{51}$$

where h and $P_t = \hat{P}_t(t)$ are recognized to be varying with time. Equating the above two, consider:

$$\frac{M_g g}{A}\left[1 - \left\{\frac{T_0}{T_0 + \alpha(L - \hat{h}(t))}\right\}^{\frac{gM_W}{\alpha R}}\right]^{-1} = -P_{\ell 0}\frac{\hat{h}(t)}{L} + \hat{P}_t(t) - \frac{\alpha\kappa P_{\ell 0}\hat{h}^2(t)}{2L} + \frac{cP_{\ell 0}^2\hat{h}(t)}{L} + \frac{cP_{\ell 0}^2\hat{h}^2(t)}{2L^2} - \frac{c\hat{P}_t(t)P_{\ell 0}\hat{h}(t)}{L}. \tag{52}$$

Thus, from a measured $P_t$ at given times t, it is possible to know $h = \hat{h}(t)$, and therefore $$\frac{dh}{dt}$$

As explained, liquid density above a plug, $\rho_{\ell tt}$, can vary with time, and can be given by Eq. 31 where $P_{\ell t}$ is obtained from Eq. 32. For this particular scenario, $P_i$ in Eq. 32 can be based on Eq. 51, once h is obtained from Eq. 52. Thus $\rho_{\ell tt}$ can be computed such that it is known. Note that Eq. 30 is also valid for a sealed borehole.

As before, Eq. 34

$$\frac{1}{\rho_{\ell tt}}\frac{dM_\ell}{dt} = q$$

can still be applicable. And, the same can be true for Eq. 35. Thus, again expanding, $P_b$ with $P_{b0} + P_{b1}(\in t)$:

$$q = A\frac{\rho_{\ell t}}{\rho_{\ell tt}}\left[\frac{dh}{dt} + \alpha\kappa h\frac{dh}{dt} - cP_{\ell 0}\frac{dh}{dt} - \frac{cP_{\ell 0}h}{L}\frac{dh}{dt} + cP_t\frac{dh}{dt} + ch\frac{dP_t}{dt}\right] \tag{53}$$

$$= C\left[P_b - P_t - \rho_{\ell tt}gl_p\right] = C\left[P_{b0} + P_{b1}(\epsilon t) - P_t - \rho_{\ell tt}gl_p\right] \tag{54}$$

Again, defining:

$$P_{b0} = \lim_{t\to 0}\left[P_t + q/C + \rho_{\ell tt}gl_p\right], \text{ and} \tag{55}$$

$$P_{t0} = -\frac{A}{C}\frac{\rho_{\ell t}}{\rho_{\ell tt}}\left[\frac{dh}{dt} + \alpha\kappa h\frac{dh}{dt} - cP_{\ell 0}\frac{dh}{dt} - \frac{cP_{\ell 0}h}{L}\frac{dh}{dt} + cP_t\frac{dh}{dt} + ch\frac{dP_t}{dt}\right] + P_{b0} - \rho_{\ell tt}gl_p, \tag{56}$$

it is possible to infer below plug creeping pressure from:

$$P_{b1}(\in t) = P_t - P_{t0}. \tag{57}$$

While the last three equations may look identical to that of a communicating borehole scenario, note that the relationship between h and $P_t$ tends to be quite different.

As to a fully filled wellbore, which may be a commonly expected scenario, particularly in offshore wells, as the liquid fills the borehole, if the wellbore is entirely sealed, pressure within the borehole may be expected to increase steadily if there is a leakage, and asymptotically reach $P_b$. In order to assess such phenomena quantitatively, it is helpful to know the compressibility of the aqueous column above the plug. A straightforward inference is possible, for example, if a known volume $V_i$ of liquid is injected into the borehole in a short time, and change in pressure $\Delta P$ measured at a fixed z. Such an approach may be accomplished using one or more types of equipment (e.g., tools, etc.), which may or may not include one or more pressure sensors.

As an example, the mean isothermal compressibility of the liquid can be:

$$c_\ell \approx \frac{1}{AL}\frac{v_i}{\Delta P^1} \tag{58}$$

as a leakage volume over a relatively short time may be neglected.

As an example, a converse application can involve measuring $P_t$ over a time $\Delta t$, and obtaining the increase $\Delta P_t$. In such an example, if a rate of change of $P_t$ with respect to t is computed, then, realizing that the flow rate is equivalent to $$\frac{dV_i}{dt}$$

$$q = C\left[P_b - P_t - \rho_{\ell tt} g l_p\right] \approx c_\ell AL \frac{dP_t}{dt}. \tag{59}$$

The foregoing approach implies that:

$$P_b \approx P_t + \rho_{\ell tt} g l_p + \frac{c_\ell AL}{C}\frac{dP_t}{dt}. \tag{60}$$

Thus, a downhole measurement of $P_t$ can be sufficient to get $P_b$ and C from the intercept and slope. Note that $c_\ell$ here can be a measured compressibility, for example, from an injection experiment at t=0 (e.g., which may not be the actual property of the liquid).

As an example, a fourth scenario not addressed above can involve a liquid filled borehole that is allowed to bleed to the atmosphere. In such an example, the flow rate out of the borehole may be translated to the downhole leak rate. As volumetric reduction and increase due to temperature and pressure are relatively small, to leading order the surface rate is nearly the same as the bottom hole rate. In such an example, a first order refinement of the top rate can also be carried out as follows.

For example, let the top rate be $q_{00}$. Let the surface temperature be $T_{00}$. As $T_0$ can be an extrapolated surface temperature, $T_{00}$ is a separate input. In such an example, if the mean volume expansivity is k at a mean pressure of approximately $$P_0 + \frac{1}{2}\rho_{\ell tt} g L$$

and a mean temperature of $(T_{00}+T_t)/2$, and similarly for isothermal compressibility $\bar{c}_\ell$, then:

$$q \approx q_{00}[1+\bar{\kappa}(T_t - T_{00}) - \bar{c}_\ell \rho_{\ell tt} g L]. \tag{61}$$

From Eq. 36, from known q and $P_t$:

$$P_b = \frac{q}{C} + P_t + \rho_{\ell tt} g l_p. \tag{62}$$

As explained, one or more methods may be utilized for quantifying a leak rate through a wellbore plug for situations where a liquid column's density may vary with both temperature and pressure comparably. With pressure measurement above the plug, a method can provide for inferring both leak rate through the plug and the pressure below the plug. Additionally, a slowly varying leak driving pressure may also be obtained.

As explained, one or more approaches may be selected depending on circumstances, changes in circumstances, etc. For example, consider the following: (i) borehole with a liquid and gas column, open to atmosphere; (ii) borehole with a liquid and gas column, isolated from atmosphere; and (iii) a fully filled wellbore, both closed and open.

As explained, a method can provide for determining a state of a plug and a bore where the plug is to hinder flow in the bore, for example, to isolate one region of the bore with respect to another region of the bore. As an example, a method can include computing a slowly varying magnitude of a pressure drive without a transducer (e.g., pressure sensor) installation below the plug, as long as a small amount of leakage is present. In the absence of such a leak, a plug and a bore as system may be deemed to be of sufficient integrity and sealing functionality. In such a state, the objective of the plug can be considered to be met and the value of knowing the bottom pressure can be diminished.

As explained, a method can provide for quantifying a leak rate through a plug. As an example, a method can include acquiring time evolving pressure measurements at a single location, which can be above the plug and relatively close to the plug. From such measurements, a leak rate through the plug to the top of the plug and the pressure drive below the plug may be computed, which may be computed for one or more of a plurality of difference scenarios, which can include: (i) borehole communicating to atmosphere with a gas and liquid column; (ii) borehole isolated from atmosphere but having a gas and liquid column; and (iii) a fully filled wellbore. As mentioned, a fourth scenario may be considered and/or refined.

As explained, a method can include acquiring pressure measurements using a pressure sensor positioned in a wellbore above a plug where acquired measurements can allow for computation of one or more characteristics of the plug as positioned in the wellbore (e.g., as a system) with respect to one or more scenarios. As explained, leakage may be a characteristic of a system and, for example, a slowly varying magnitude of a pressure drive may be a characteristic, which can be determined without a pressure sensor installed below the plug, as long as a small amount of leakage is present. In the absence of such leakage, a plug in a wellbore (e.g., as a system) may be deemed to be of sufficient integrity without detectable leakage. Where detectable leakage is not present, in various instances, the value of knowing the bottom pressure may be diminished.

Figure 10:
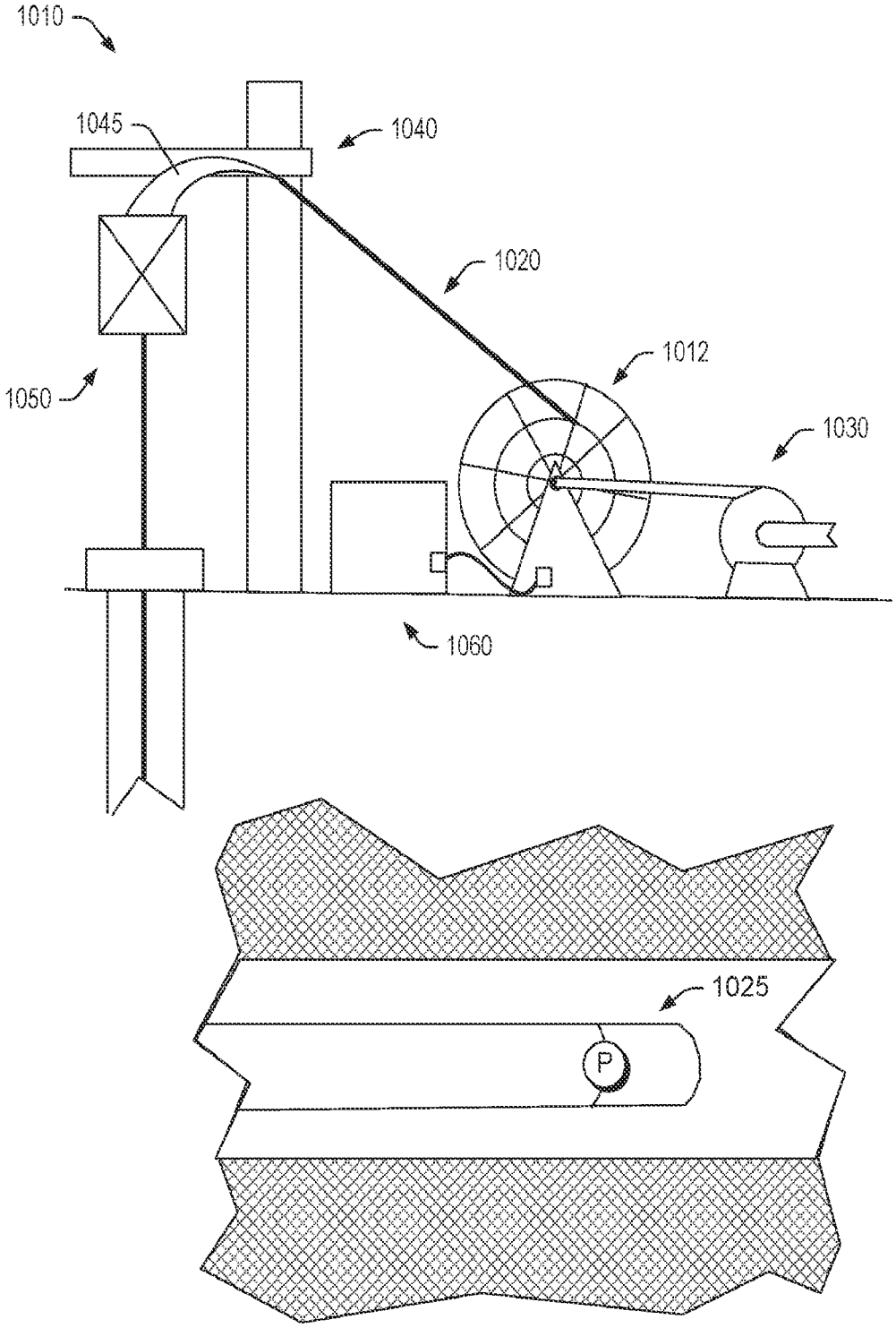
FIG. 10 illustrates examples of equipment.

FIG. 10 shows an example of a geologic environment 1000 and a system 1010 positioned with respect to the geologic environment 1000. As shown, the geologic environment 1000 may include at least one bore. In the example of FIG. 10, the system 1010 may include a reel for deploying coil tubing that is operatively coupled to a tool 1025 that includes at least one pressure sensor. As an example, the system 1010 may include a rig 1040 that carries a coil tubing mechanism such as a gooseneck 1045 and a coil tubing box 1050 that may function to transition coil tubing from a reel to a downward direction for positioning in a bore.

As an example, the system 1010 may include a pump 1030, which may operate to pump fluid (e.g., in one or more directions). As an example, the pump 1030 may be operatively coupled to the coil tubing 1020 for purposes of pumping fluid into or out of the coil tubing 1020. As an example, fluid may be a material that can form a plug, for example, cement slurry, etc.

As an example, the coil tubing 1020 may include one or more wires, for example, to carry power, signals, etc. For example, one or more wires may operatively couple to the tool 1025 for purposes of powering a sensor, receiving information from a sensor, etc. As shown in the example of FIG. 10, a unit 1060 may include circuitry that is electrically coupled (e.g., via wire or wirelessly) to the tool 1025, for example, via a deployment mechanism. As an example, the coil tubing 1020 may include or carry one or more wires and/or other communication equipment (e.g., fiber optics, rely circuitry, wireless circuitry, etc.) that are operatively coupled to the tool 1025. As an example, the unit 1060 may process information acquired by the tool 1025. As an example, the unit 1060 may include one or more controllers for controlling, for example, operation of one or more components of the system 1010 (e.g., the reel 1012, the pump 1030, etc.). As an example, the unit 1060 may include circuitry to control depth/distance of deployment of the tool 1025. As an example, the unit 1060 may include circuitry, modules, etc. for implementation, at least in part, of one or more of methods (see, e.g., scenarios 810, 830 and 850 of FIG. 8, etc.).

As an example, a sensor or sensors may provide for sensing a plug and/or a distance from a plug. For example, consider sensing a distance from a plug for adjusting a position of a sensor that can sense pressure. As an example, a method can include sensing pressure during movement of coiled tubing, wireline, etc. In such an example, a calibration process may utilize acquired present sensor measurements with respect to a vertical depth, which may correspond to a head pressure (e.g., a pressure that varies with respect to a z coordinate). As an example, where coiled tubing is utilized that can pump fluid, a method can include pumping an amount of fluid and measuring pressure. For example, where fluid causes an increase in a head above a pressure sensor, a pressure reading may increase correspondingly and/or, for example, where fluid is pumped out of a bore, a head may decrease and be expected to cause a corresponding decrease in a pressure reading.

As an example, a sensor can be a temperature sensor. For example, a tool may include a pressure sensor, a temperature sensor and optionally one or more other sensors. As an example, a tool may provide for making temperature measurements to acquire temperature information, which may be utilized to determine a geothermal gradient (e.g., a geothermal profile) of at least a portion of a bore (e.g., geothermal profile of a formation, etc.). As explained, a geothermal gradient (e.g., a geothermal profile, etc.) may be utilized to make one or more computations as to state of a plug and a bore (e.g., a plug in a bore of a formation as a system that is intended to seal the bore). As an example, a geothermal acquisition process may utilize a tool that can pump fluid into and/or out of a bore where acquired data, together with flow information, may help to compute a geothermal profile. As an example, a method can include utilizing an ESP for pumping where the ESP can include various sensors (e.g., pressure, temperature, etc.).

A geothermal gradient can be a rate of increase in temperature per unit depth in the Earth. Although the geothermal gradient can vary from place to place, in various types of formations, regions, etc., it may tend to average from approximately 25 degrees C. to approximately 30 degrees C. per km. However, it may be less than 25 degrees C. per km in one or more regions. For example, it may be less than 20 degrees C. per km, less than 15 degrees C. per km, less than 10 degrees C. per km, etc. As an example, a method can include determining that the geothermal gradient in an uphole region is greater than a certain value and, in response, utilizing an approach that may not account for gravitational head induced density variation in liquid as, for example, a temperature induced density variation can be greater than the gravitational head induced density variation. As an example, a method can include determining that the geothermal gradient in an uphole region is less than a certain value and, in response, utilizing an approach that may account for gravitational head induced density variation in liquid as, for example, a temperature induced density variation can be of the same order or less than the gravitational head induced density variation. Temperature gradients may at times increase dramatically around volcanic areas. As an example, an estimate of a geothermal gradient can be determined by temperature measurements at two points. As an example, a downhole temperature at one location may be estimated using a geothermal profile and a temperature at another location. As explained, one or more techniques, tools, etc., may be utilized to determine a geothermal gradient (e.g., a geothermal profile, etc.).

While various aspects of the system 1010 of FIG. 10 refer to coiled tubing, as explained, wireline or another manner of deployment, transmission, communication, etc., may be utilized. As an example, a pressure sensor may be deployed using one or more technologies where the pressure sensor is deployed with memory that can store acquired pressure data that can be transferred to a computing system for analysis. As an example, a pressure sensor may be part of a weighted device that can detach or otherwise reduce its weight such that it can rise in a column of liquid (e.g., to move uphole).

As an example, a tool that is deployable in a bore can include one or more sensors that can detect a gas-fluid interface. For example, consider the scenario 810 of FIG. 8 where gas may be air that is in a region above a fluid region. In such an example, deployment of the tool may detect the gas-fluid interface and utilize the detected interface in determining a characteristic of a gas region (e.g., length, etc.) and/or in determining a characteristic of a fluid region (e.g., length, etc.). In such an example, where a depth of a plug is known a priori, knowledge of a gas-fluid interface may provide for determination of a gas region length (e.g., and a volume of gas, etc.) and a fluid region length (e.g., and a volume of fluid, etc.).

As explained, a tube or tubing can include a pressure sensor where the tube or tubing may be utilized to deliver material as part of a plugging operation. In such an example, the pressure sensor may be utilized to acquire pressure data before flow of material, during flow of material and/or after flow of material. For example, consider a pressure sensor that can acquire a baseline pressure, a during material delivery pressure, a post-material delivery pressure and a post-setting pressure. As explained, pressure data can be utilized for computations indicative of leakage and, optionally, below plug pressure.

Figure 11:
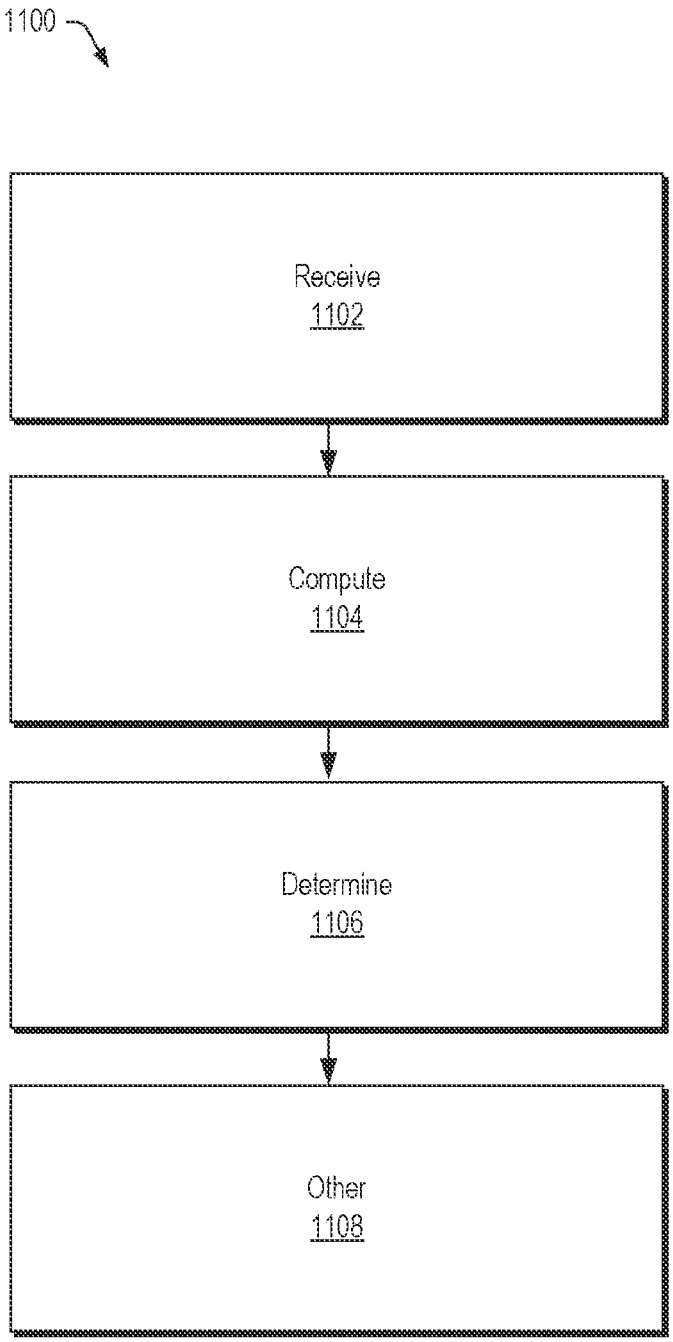
FIG. 11 illustrates an example of a method.

FIG. 11 shows an example of a method 1100 that includes a reception block 1102 for receiving pressure data with respect to time acquired via a pressure sensor disposed in an uphole region of a bore of a well, where a plug is disposed in the bore to define the uphole region to one side of the plug and a corresponding downhole region to the other side of the plug; a computation block 1104 for, using at least physical properties of liquid in the uphole region and thermal information, computing a temperature and gravitational head induced density variation of the liquid in the uphole region; and, a determination block 1106 for, based at least in part on at least a portion of the pressure data and the temperature and gravitational head induced density variation of the liquid, determining a state of the plug and the bore from a plurality of states. In such an example, one or more downhole tool actions may be performed and, for example, pressure data acquired. As an example, depending on a state, a method can include performing one or more actions that can include a plugging operation. For example, consider determining one or more aspects of a leak and tailoring a plugging operation (e.g., material, timing, location, etc.) to address the leak by reinforcing a plug, making a new plug, etc. In the example method 1100, an other block 1108 can be utilized to perform one or more additional actions.

As an example, a method can include receiving pressure data with respect to time acquired via a pressure sensor disposed in an uphole region of a bore of a well, where a plug is disposed in the bore to define the uphole region to one side of the plug and a corresponding downhole region to the other side of the plug; using at least physical properties of liquid in the uphole region and thermal information, computing a temperature and gravitational head induced density variation of the liquid in the uphole region; and, based at least in part on at least a portion of the pressure data and the temperature and gravitational head induced density variation of the liquid, determining a state of the plug and the bore from a plurality of states. In such an example, the thermal information can include geothermal gradient information for at least a portion of the uphole region of the borehole.

As an example, a maximum variation of density variation of liquid in an uphole region due to gravitational head may be at least 10 percent of a minimum variation of density variation of the liquid in the uphole region due to temperature.

As an example, a variation of density variation of liquid in an uphole region due to gravitational head may exceed a variation of density variation of the liquid in the uphole region due to temperature.

As an example, geothermal gradient information may be indicative of a geothermal gradient less than approximately 30 degrees C. per kilometer, less than approximately 20 degrees C. per kilometer, less than approximately 15 degrees C. per kilometer, less than approximately 10 degrees C. per kilometer, etc. As an example, a method can include utilizing a value for a geothermal gradient to assess temperature and/or gravitational head induced effects as to liquid density to determine one or more types of relationships to utilize in performing a leak analysis (e.g., a leak detection method, etc.). As mentioned, one or more tools may be utilized to acquire data as to one or more phenomena, which may include one or more of pressure and temperature (e.g., consider a pressure profile, a temperature profile, etc.). As an example, a tool can provide for pumping of fluid, which may be pumped into a borehole and/or pumped out of a borehole.

As an example, a method can include acquiring thermal information using one or more downhole sensors and computing a geothermal gradient.

As an example, a plurality of states can include a no leakage state and a leakage state.

As an example, a method can include determining presence of liquid or liquid and gas in an uphole region and, responsive to the presence of liquid or liquid and gas, selecting one or more relationships for computing density variation of the liquid or of the liquid and gas in the uphole region. In such an example, the method can include determining presence of liquid communication with atmospheric pressure or gas communication with atmospheric pressure.

As an example, a method can include determining a presence of one of: gas in a portion of an uphole region uphole liquid where the gas is in pressure communication with atmosphere; gas in a portion of the uphole region uphole the liquid wherein the gas is not in pressure communication with atmosphere; and the liquid extending to a top of the uphole region without a separate gas region therein wherein the liquid is not in pressure communication with atmosphere.

As an example, in a leakage state of a plug and a bore (e.g., as a system), a height parameter of liquid in an uphole region can be a function with respect to time.

As an example, a height of liquid in an uphole region can be more than ten times greater than a height of a plug.

As an example, a method can include determining that gas exists in a portion of an uphole region that is uphole from liquid in the uphole region and, responsive to the determining, using physical properties of the gas and at least a portion of thermal information, computing an environmentally induced density variation of the gas in the portion of the uphole region. In such an example, the computing an environmentally induced density variation can include accounting for pressure effect on the gas in the portion of the uphole region.

As an example, a method can include estimating pressure with respect to time for a downhole region proximate to a plug and estimating a flow rate from the downhole region to an uphole region using a computed relationship and at least a portion of the pressure data.

As an example, a system can include a processor; memory accessible by the processor; processor-executable instructions stored in the memory and executable to instruct the system to: receive pressure data with respect to time acquired via a pressure sensor disposed in an uphole region of a bore of a well, where a plug is disposed in the bore to define the uphole region to one side of the plug and a corresponding downhole region to the other side of the plug; using at least physical properties of liquid in the uphole region and thermal information, compute a temperature and gravitational head induced density variation of the liquid in the uphole region; and, based at least in part on at least a portion of the pressure data and the temperature and gravitational head induced density variation of the liquid, determine a state of the plug and the bore from a plurality of states.

As an example, one or more computer-readable storage media can include processor-executable instructions to instruct a computing system to: receive pressure data with respect to time acquired via a pressure sensor disposed in an uphole region of a bore of a well, wherein a plug is disposed in the bore to define the uphole region to one side of the plug and a corresponding downhole region to the other side of the plug; using at least physical properties of liquid in the uphole region and thermal information, compute a temperature and gravitational head induced density variation of the liquid in the uphole region; and, based at least in part on at least a portion of the pressure data and the temperature and gravitational head induced density variation of the liquid, determine a state of the plug and the bore from a plurality of states.

A method can be associated with various computer-readable media (CRM) blocks. Such blocks generally include instructions suitable for execution by one or more processors (or cores) to instruct a computing device or system to perform one or more actions. While various blocks are shown, a single medium may be configured with instructions to allow for, at least in part, performance of various actions of a method. As an example, a CRM block can be a computer-readable storage medium that is non-transitory, not a carrier wave and not a signal. As an example, such blocks can include instructions that can be stored in memory and can be executable by one or more of processors.

As an example, a method may be implemented in part using computer-readable media (CRM), for example, as a module, a block, etc. that include information such as instructions suitable for execution by one or more processors (or processor cores) to instruct a computing device or system to perform one or more actions. As an example, a single medium may be configured with instructions to allow for, at least in part, performance of various actions of a method. As an example, a computer-readable medium (CRM) may be a computer-readable storage medium (e.g., a non-transitory medium) that is not a carrier wave.

According to an embodiment, one or more computer-readable media may include computer-executable instructions to instruct a computing system to output information for controlling a process. For example, such instructions may provide for output to sensing process, an injection process, drilling process, an extraction process, an extrusion process, a pumping process, a heating process, etc.

Figure 12:
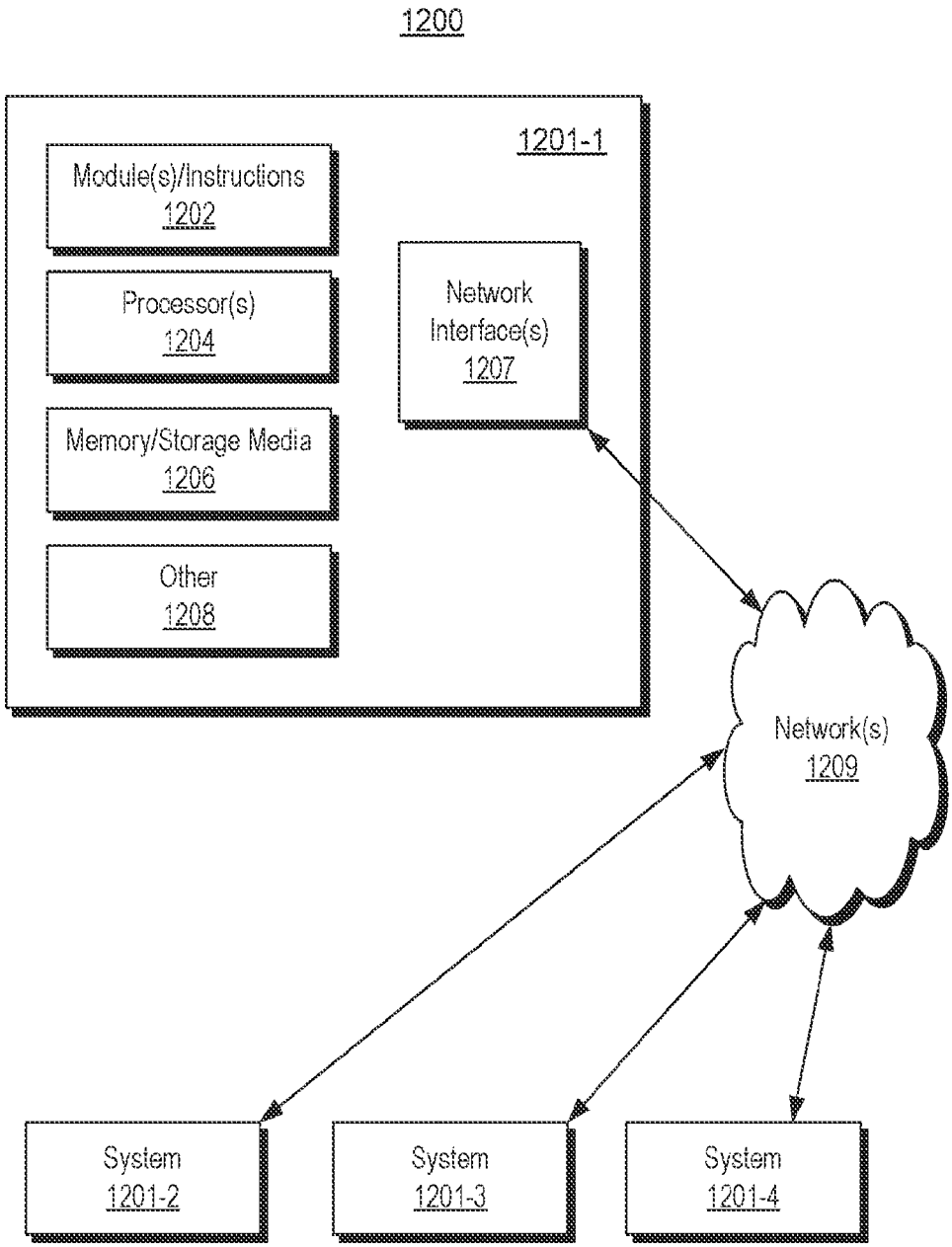
FIG. 12 illustrates an example of computing system.

In some embodiments, a method or methods may be executed by a computing system. FIG. 12 shows an example of a system 1200 that can include one or more computing systems 1201-1, 1201-2, 1201-3 and 1201-4, which may be operatively coupled via one or more networks 1209, which may include wired and/or wireless networks.

As an example, a system can include an individual computer system or an arrangement of distributed computer systems. In the example of FIG. 12, the computer system 1201-1 can include one or more modules 1202, which may be or include processor-executable instructions, for example, executable to perform various tasks (e.g., receiving information, requesting information, processing information, simulation, outputting information, etc.).

As an example, a module may be executed independently, or in coordination with, one or more processors 1204, which is (or are) operatively coupled to one or more storage media 1206 (e.g., via wire, wirelessly, etc.). As an example, one or more of the one or more processors 1204 can be operatively coupled to at least one of one or more network interface 1207. In such an example, the computer system 1201-1 can transmit and/or receive information, for example, via the one or more networks 1209 (e.g., consider one or more of the Internet, a private network, a cellular network, a satellite network, etc.).

As an example, the computer system 1201-1 may receive from and/or transmit information to one or more other devices, which may be or include, for example, one or more of the computer systems 1201-2, etc. A device may be located in a physical location that differs from that of the computer system 1201-1. As an example, a location may be, for example, a processing facility location, a data center location (e.g., server farm, etc.), a rig location, a wellsite location, a downhole location, etc.

As an example, a processor may be or include a microprocessor, microcontroller, processor module or subsystem, programmable integrated circuit, programmable gate array, or another control or computing device.

As an example, the storage media 1206 may be implemented as one or more computer-readable or machine-readable storage media. As an example, storage may be distributed within and/or across multiple internal and/or external enclosures of a computing system and/or additional computing systems.

As an example, a storage medium or storage media may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories, magnetic disks such as fixed, floppy and removable disks, other magnetic media including tape, optical media such as compact disks (CDs) or digital video disks (DVDs), BLUERAY® disks, or other types of optical storage, or other types of storage devices.

As an example, a storage medium or media may be located in a machine running machine-readable instructions, or located at a remote site from which machine-readable instructions may be downloaded over a network for execution.

As an example, various components of a system such as, for example, a computer system, may be implemented in hardware, software, or a combination of both hardware and software (e.g., including firmware), including one or more signal processing and/or application specific integrated circuits.

As an example, a system may include a processing apparatus that may be or include a general purpose processors or application specific chips (e.g., or chipsets), such as ASICs, FPGAs, PLDs, or other appropriate devices.

Figure 13:
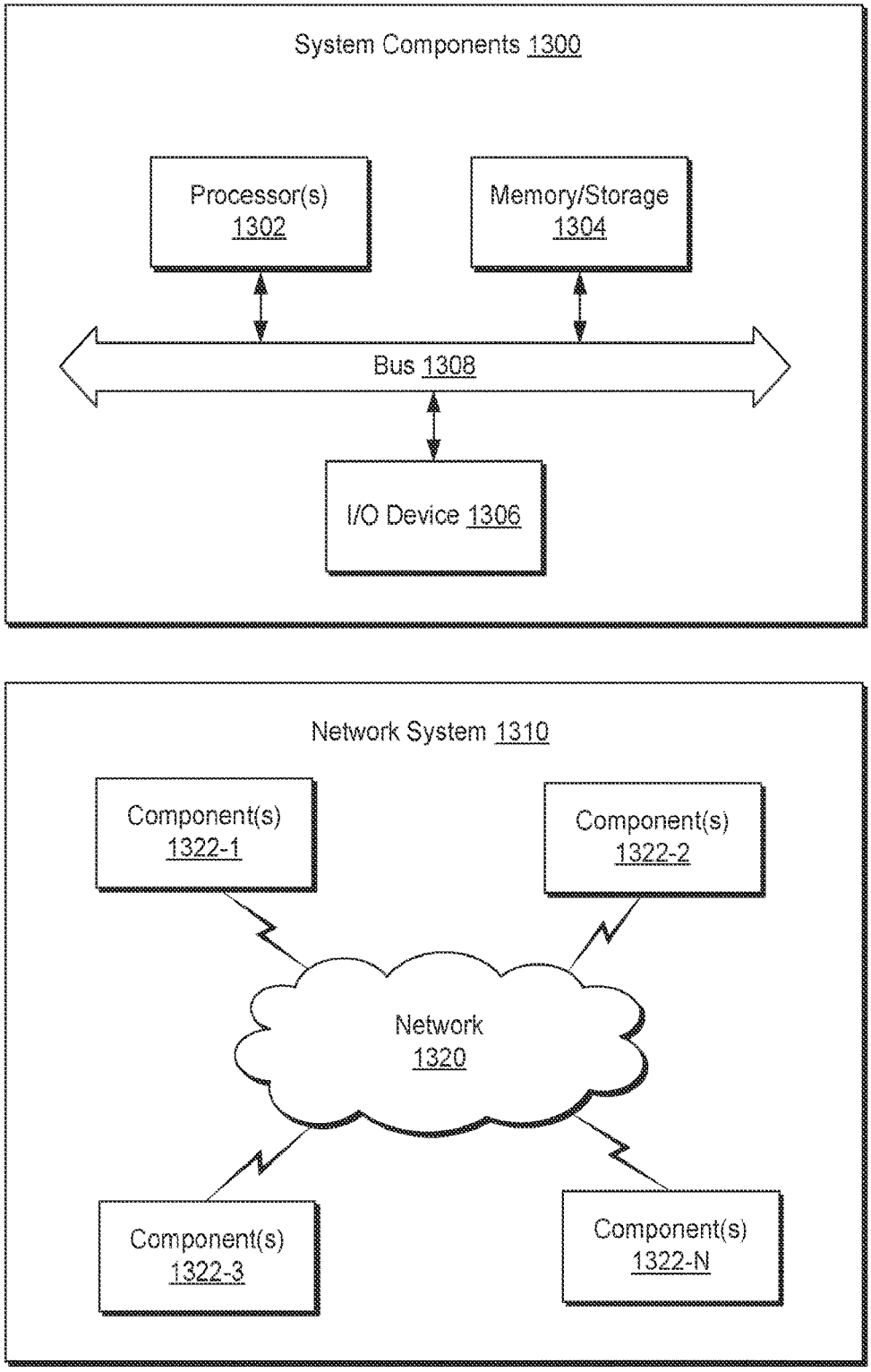
FIG. 13 illustrates example components of a system and a networked system.

FIG. 13 shows components of a computing system 1300 and a networked system 1310 with a network or networks 1320. The system 1300 includes one or more processors 1302, memory and/or storage components 1304, one or more input and/or output devices 1306 and a bus 1308. According to an embodiment, instructions may be stored in one or more computer-readable media (e.g., memory/storage components 1304). Such instructions may be read by one or more processors (e.g., the processor(s) 1302) via a communication bus (e.g., the bus 1308), which may be wired or wireless. The one or more processors may execute such instructions to implement (wholly or in part) one or more attributes (e.g., as part of a method). A user may view output from and interact with a process via an I/O device (e.g., the device 1306). According to an embodiment, a computer-readable medium may be a storage component such as a physical memory storage device, for example, a chip, a chip on a package, a memory card, etc.

According to an embodiment, components may be distributed, such as in the network system 1310. The network system 1310 includes components 1322-1, 1322-2, 1322-3, . . . 1322-N. For example, the components 1322-1 may include the processor(s) 1302 while the component(s) 1322-3 may include memory accessible by the processor(s) 1302. Further, the component(s) 1322-2 may include an I/O device for display and optionally interaction with a method. The network may be or include the Internet, an intranet, a cellular network, a satellite network, etc.

As an example, a device may be a mobile device that includes one or more network interfaces for communication of information. For example, a mobile device may include a wireless network interface (e.g., operable via IEEE 802.11, ETSI GSM, BLUETOOTH®, satellite, etc.). As an example, a mobile device may include components such as a main processor, memory, a display, display graphics circuitry (e.g., optionally including touch and gesture circuitry), a SIM slot, audio/video circuitry, motion processing circuitry (e.g., accelerometer, gyroscope), wireless LAN circuitry, smart card circuitry, transmitter circuitry, GPS circuitry, and a battery. As an example, a mobile device may be configured as a cell phone, a tablet, etc. As an example, a method may be implemented (e.g., wholly or in part) using a mobile device. As an example, a system may include one or more mobile devices.

As an example, a system may be a distributed environment, for example, a so-called "cloud" environment where various devices, components, etc. interact for purposes of data storage, communications, computing, etc. As an example, a device or a system may include one or more components for communication of information via one or more of the Internet (e.g., where communication occurs via one or more Internet protocols), a cellular network, a satellite network, etc. As an example, a method may be implemented in a distributed environment (e.g., wholly or in part as a cloud-based service).

As an example, information may be input from a display (e.g., consider a touchscreen), output to a display or both. As an example, information may be output to a projector, a laser device, a printer, etc. such that the information may be viewed. As an example, information may be output stereographically or holographically. As to a printer, consider a 2D or a 3D printer. As an example, a 3D printer may include one or more substances that can be output to construct a 3D object. For example, data may be provided to a 3D printer to construct a 3D representation of a subterranean formation. As an example, layers may be constructed in 3D (e.g., horizons, etc.), geobodies constructed in 3D, etc. As an example, holes, fractures, etc., may be constructed in 3D (e.g., as positive structures, as negative structures, etc.).

Although only a few examples have been described in detail above, those skilled in the art will readily appreciate that many modifications are possible in the examples. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

Appendix: Mean Pressure and Temperature

Compressibility and expansivity of the liquid can be based on an estimate of the mean pressure and temperature over the liquid column. In particular, consider taking the mean pressure based on $\frac{1}{2}[\min(P_i)+\max(P_t)]$. These depend on the value of h, its minimum or maximum values. For example, in both open and closed borehole, it can be expected that the $\max(P_t)$ is obtained when h is the largest. The minimum $P_i$ in an open borehole may also be likely when h is the largest. In a closed borehole, based on Eq. 50, can also result in a minimum for $P_i$ when h is the highest. With regard to temperature, $T_t$ can be the largest. The minimum in $T_i$ can be obtained at the largest value of h.

To estimate the largest value of h it can be that values for c and κ are to be provided, and, in turn, these demand h. For small values of δ and ε, a good approximation may be obtained through a sequential procedure. For example, assume C, κ=0. Then $\rho_\ell=\rho_{\ell t}$. Then, for a communicating borehole, Eq. 24 can be reduced to:

$$P_0\left[\frac{T_0+\alpha(L-h)}{T_0}\right]^{\frac{M_w g}{\alpha R}}=-P_{\ell 0}\frac{h}{L}+P_t. \tag{63}$$

Similarly, for a sealed borehole:

$$\frac{M_g g}{A}\left[1-\left\{\frac{T_0}{T_0+\alpha\left(L-\tilde{h}(t)\right)}\right\}^{\frac{gM_w}{\alpha R}}\right]^{-1}=-P_{\ell 0}\frac{h}{L}+P_t. \tag{64}$$

The foregoing approach allows for obtaining h from measured $P_t$. Thus, the maximum value of h can be approximately known. The lowest $T_i$ and $P_i$ can also be known, for example, the former from geothermal gradient, and the latter from Eq. 23 for a communicating borehole and from Eq. 51 for a sealed borehole. This allows for calculation of c and κ. Since the influence of c and κ can be considered to be first order adjustments, and as further refinement to these values can be of a higher order (e.g., second order), various methods can be suitable for making acceptable determinations without further refinement.

What is claimed is:

1. A method, comprising:

receiving pressure data with respect to time acquired via a pressure sensor disposed in an uphole region of a bore of a well, a plug being disposed in the bore to define the uphole region to one side of the plug and a corresponding downhole region to another side of the plug opposite to the one side of the plug;

using at least physical properties of a liquid in the uphole region and thermal information:

computing a temperature induced density variation of the liquid in the uphole region; and computing a gravitational head induced density variation of the liquid in the uphole region;

based at least in part on at least a portion of the pressure data, the temperature induced density variation of the liquid, and the gravitational head induced density variation of the liquid, determining a state of the plug and the bore from a plurality of states; and in response to the determined state of the plug indicating that a leak is occurring, performing a plugging operation on the plug to control the leak, wherein a variation of the gravitational head induced density variation of the liquid in the uphole region due to gravitational head exceeds a variation of the temperature induced density variation of the liquid in the uphole region due to temperature.

2. The method of claim 1, wherein the thermal information comprises geothermal gradient information for at least a portion of the uphole region of the bore of the well.

3. The method of claim 1, wherein a maximum variation of the gravitational head induced density variation of the liquid in the uphole region due to gravitational head is at least 10 percent of a minimum variation of the temperature induced density variation of the liquid in the uphole region due to temperature.

4. The method of claim 2, wherein the geothermal gradient information is indicative of a geothermal gradient less than approximately 30 degrees C. per kilometer.

5. The method of claim 2, wherein the geothermal gradient information is indicative of a geothermal gradient less than approximately 20 degrees C. per kilometer.

6. The method of claim 2, wherein the geothermal gradient information is indicative of a geothermal gradient less than approximately 15 degrees C. per kilometer.

7. The method of claim 2, wherein the geothermal gradient information is indicative of a geothermal gradient less than approximately 10 degrees C. per kilometer.

8. The method of claim 1, further comprising acquiring the thermal information using one or more downhole sensors and computing a geothermal gradient.

9. The method of claim 1, wherein the plurality of states comprise a no leakage state and a leakage state.

10. The method of claim 1, further comprising:

determining a presence of the liquid or the liquid and gas in the uphole region; and responsive to the presence of the liquid or the liquid and gas, selecting one or more relationships for computing density variation of the liquid or of the liquid and gas in the uphole region.

11. The method of claim 10, further comprising determining a presence of liquid communication with atmospheric pressure or gas communication with atmospheric pressure.

12. The method of claim 1, further comprising determining a presence of one or more of:

gas in a portion of the uphole region uphole from the liquid, the gas being in pressure communication with atmosphere;

gas in a portion of the uphole region uphole from the liquid, the gas being not in pressure communication with atmosphere; or the liquid extending to a top of the uphole region without a separate gas region therein, the liquid being not in pressure communication with atmosphere.

13. The method of claim 1, wherein, in a leakage state of the plug and the bore, a height parameter of the liquid in the uphole region is a function with respect to time.

14. The method of claim 1, wherein a height of the liquid in the uphole region is more than ten times greater than a height of the plug.

15. The method of claim 1, further comprising:

determining that gas exists in a portion of the uphole region that is uphole from the liquid in the uphole region; and responsive to the determining, using physical properties of the gas and at least a portion of the thermal information, computing an environmentally induced density variation of the gas in the portion of the uphole region.

16. The method of claim 15, wherein the computing an environmentally induced density variation comprises accounting for pressure effect on the gas in the portion of the uphole region.

17. The method of claim 1, further comprising:

estimating pressure with respect to time for the downhole region proximate to the plug; and estimating a flow rate from the downhole region to the uphole region using a computed relationship and at least a portion of the pressure data.

18. A system, comprising:

one or more processors;

memory accessible by the one or more processors;

processor-executable instructions stored in the memory and executable to instruct the system to:

receive pressure data with respect to time acquired via a pressure sensor disposed in an uphole region of a bore of a well, a plug being disposed in the bore to define the uphole region to one side of the plug and a corresponding downhole region to another side of the plug opposite to the one side of the plug;

using at least physical properties of a liquid in the uphole region and thermal information:

compute a temperature induced density variation of the liquid in the uphole region; and compute a gravitational head induced density variation of the liquid in the uphole region;

based at least in part on at least a portion of the pressure data, the temperature induced density variation of the liquid, and the gravitational head induced density variation of the liquid, determine a state of the plug and the bore from a plurality of states; and in response to the determined state of the plug indicating that a leak is occurring, performing a plugging operation on the plug to control the leak, wherein a variation of the gravitational head induced density variation of the liquid in the uphole region due to gravitational head exceeds a variation of the temperature induced density variation of the liquid in the uphole region due to temperature.

19. One or more computer-readable storage media comprising processor-executable instructions to instruct a computing system to:

receive pressure data with respect to time acquired via a pressure sensor disposed in an uphole region of a bore of a well, a plug being disposed in the bore to define the uphole region to one side of the plug and a corresponding downhole region to another side of the plug opposite to the one side of the plug;

using at least physical properties of a liquid in the uphole region and thermal information:

compute a temperature induced density variation of the liquid in the uphole region; and compute a gravitational head induced density variation of the liquid in the uphole region;

based at least in part on at least a portion of the pressure data, the temperature induced density variation of the liquid, and the gravitational head induced density variation of the liquid, determine a state of the plug and the bore from a plurality of states; and in response to the determined state of the plug indicating that a leak is occurring, performing a plugging operation on the plug to control the leak, wherein a variation of the gravitational head induced density variation of the liquid in the uphole region due to gravitational head exceeds a variation of the temperature induced density variation of the liquid in the uphole region due to temperature.

* * * * *